US012320599B2

(12) United States Patent
Ader

(10) Patent No.: US 12,320,599 B2
(45) Date of Patent: Jun. 3, 2025

(54) FIREARM FIRE CONTROL MECHANISMS AND RELATED TECHNIQUES

(71) Applicant: Henry RAC Holding Corp, Rice Lake, WI (US)

(72) Inventor: Geoffrey Louis Ader, Chetek, WI (US)

(73) Assignee: Henry RAC Holding Corp, Rice Lake, WI (US)

( * ) Notice: Subject to any disclaimer, the term of this patent is extended or adjusted under 35 U.S.C. 154(b) by 0 days.

(21) Appl. No.: 18/465,491

(22) Filed: Sep. 12, 2023

(65) Prior Publication Data

US 2024/0093956 A1 Mar. 21, 2024

Related U.S. Application Data

(60) Provisional application No. 63/406,071, filed on Sep. 13, 2022.

(51) Int. Cl.
*F41A 17/56* (2006.01)
*F41A 17/74* (2006.01)

(52) U.S. Cl.
CPC ..... *F41A 17/56* (2013.01); *F41A 17/74* (2013.01)

(58) Field of Classification Search
CPC ..... F41A 17/56; F41A 17/74
See application file for complete search history.

(56) References Cited

U.S. PATENT DOCUMENTS

| | | | | |
|---|---|---|---|---|
| 3,092,924 | A | 6/1963 | Seecamp | |
| 3,287,842 | A | 11/1966 | Smith | |
| 3,808,724 | A | 5/1974 | Linde | |
| 3,949,508 | A * | 4/1976 | Elkas | F41A 17/62 42/70.08 |
| 4,926,574 | A * | 5/1990 | Rieger | F41A 19/34 42/70.08 |
| 4,964,232 | A | 10/1990 | Mainland et al. | |
| 5,467,549 | A | 11/1995 | Rowlands et al. | |
| 8,464,456 | B2 * | 6/2013 | Pichler | F41A 19/41 42/70.08 |
| 9,091,501 | B2 * | 7/2015 | Pichler | F41A 19/52 |

OTHER PUBLICATIONS

International Search Report and Written Opinion dated Feb. 15, 2024 for International Application No. PCT/US2023/074007.

* cited by examiner

*Primary Examiner* — Michelle Clement
(74) *Attorney, Agent, or Firm* — Wolf, Greenfield & Sacks, P.C.

(57) ABSTRACT

The techniques described herein relate to methods and apparatuses for firearm fire control mechanisms. The firearm includes a safety bar configured to engage with a safety selector and with a trigger and to transition between a first safety configuration and a second safety configuration, and a sear configured to engage with the trigger and to transition between a first sear configuration and a second sear configuration, wherein in the first sear configuration, the sear or trigger is engaged with a hammer to prevent the hammer from being released to fire the firearm, and in the second sear configuration, the sear does not prevent the hammer from being released to fire the firearm.

20 Claims, 22 Drawing Sheets

FIREARM FIRE CONTROL MECHANISMS AND RELATED TECHNIQUES

RELATED APPLICATION

This patent claims priority under 35 U.S.C. § 119(e) to U.S. Provisional Application No. 63/406,071, titled "FIREARM FIRE CONTROL MECHANISMS AND RELATED TECHNIQUES," filed on Sep. 13, 2022, which is hereby incorporated by reference herein in its entirety.

TECHNICAL FIELD

The techniques described herein are generally related to fire control mechanisms.

BACKGROUND

Generally, a firearm is a device that is designed to expel a projectile (e.g., a bullet) through the barrel of the firearm upon activation of an explosive (e.g., gunpowder within a casing of a cartridge that also holds the bullet). Firearms often include a trigger configured to actuate a firing pin to strike a fuse (e.g., a primer) of the cartridge to ignite the explosive, which causes the projectile(s) (e.g., including a bullet) to be expelled through the barrel of the firearm. Such interaction of the firing pin to the fuse is often controlled by depressing the trigger.

SUMMARY OF INVENTION

Some embodiments relate to a firearm comprising: a safety bar configured to engage with a safety selector and with a trigger and to transition between a first safety configuration and a second safety configuration; and a sear configured to engage with the trigger and to transition between a first sear configuration and a second sear configuration, wherein: in the first safety configuration, the safety bar is engaged with the safety selector such that the safety bar is engaged with the trigger to prevent the sear from being actuated, in the second safety configuration, the safety bar is engaged with the safety selector such that the safety bar is not engaged with the trigger, thereby allowing the trigger to be actuated to move the sear from the first sear configuration to the second sear configuration, in the first sear configuration, the sear or trigger is engaged with a hammer to prevent the hammer from being released to fire the firearm, and in the second sear configuration, the sear does not prevent the hammer from being released to fire the firearm.

Some embodiments relate to a firearm comprising: a safety bar configured to engage with a safety selector and with a sear and to transition between a first safety configuration and a second safety configuration; and a sear configured to engage with the trigger and to transition between a first sear configuration and a second sear configuration, wherein: in the first safety configuration, the safety bar is engaged with the safety selector such that the safety bar is engaged with the sear to prevent the sear from being actuated, in the second safety configuration, the safety bar is engaged with the safety selector such that the safety bar is not engaged with the sear, thereby allowing the trigger to be actuated to move the sear from the first sear configuration to the second sear configuration, in the first sear configuration, the sear or trigger is engaged with a hammer to prevent the hammer from being released to fire the firearm, and in the second sear configuration, the sear does not prevent the hammer from being released to fire the firearm.

Some embodiments relate to a firearm comprising: a safety bar configured to engage with a safety selector and with a trigger and to transition between a first safety configuration and a second safety configuration, wherein: in the first safety configuration, the safety bar is engaged with the safety selector such that the safety bar is engaged with the trigger to prevent the trigger from being actuated, in the second safety configuration, the safety bar is engaged with the safety selector such that the safety bar is not engaged with the trigger, thereby allowing the trigger to be actuated to move the sear surface of the trigger from the first trigger configuration to the second trigger configuration, in the first trigger configuration, the sear surface of the trigger is engaged with a hammer to prevent the hammer from being released to fire the firearm, and in the second trigger configuration, the sear surface of the trigger does not prevent the hammer from being released to fire the firearm.

Some embodiments relate to a firearm comprising: a safety bar configured to engage with a safety selector and with a trigger or sear and to transition between a first safety configuration and a second safety configuration, wherein: in the first safety configuration, the safety bar is engaged with the safety selector such that the safety bar is engaged with the trigger or sear to prevent the trigger from being actuated and/or to prevent the sear from releasing the hammer to fire the firearm, and in the second safety configuration, the safety bar is engaged with the safety selector such that the safety bar is not engaged with the trigger or sear, allowing the trigger to be actuated and/or allowing the sear to release the hammer to fire the firearm, and the safety bar includes a region configured to receive a portion of the safety selector, and the safety bar is configured to engage with the safety selector via the region and the portion.

Some embodiments relate to a firearm comprising: a pivoter configured to engage with a trigger or sear and to transition between a first pivoter configuration and a second pivoter configuration; and a lever, wherein: in the first pivoter configuration: the pivoter is engaged with the trigger to prevent the trigger from being actuated when the lever is open, and in the second pivoter configuration: the pivoter is not engaged with the trigger, allowing the trigger to be actuated, when the lever is closed.

Some embodiments relate to a firearm comprising: a pivoter configured to engage with a trigger or sear and to transition between a first pivoter configuration and a second pivoter configuration; and a lever, wherein: in the first pivoter configuration: the pivoter is engaged with the sear when the lever is open to prevent the sear from releasing the hammer to fire the firearm, and in the second pivoter configuration: the pivoter is not engaged with the sear when the lever is closed, allowing the sear to release the hammer to fire the firearm upon actuation of the trigger.

Some embodiments relate to a firearm comprising: a trigger; and a sear configured to engage with the trigger and to transition between a first sear configuration and a second sear configuration, wherein: in the first sear configuration, the sear is engaged with a hammer to prevent the hammer from being released to fire the firearm, in the second sear configuration, the sear does not prevent the hammer from being released to fire the firearm, the sear is biased towards the second sear configuration and when the trigger is in an unactuated position, the sear is prevented from moving to the second sear configuration by the trigger, and when the trigger is actuated, the sear moves to the second sear configuration.

There has thus been outlined, rather broadly, the features of the disclosed subject matter in order that the detailed description thereof that follows may be better understood, and in order that the present contribution to the art may be better appreciated. There are, of course, additional features of the disclosed subject matter that will be described hereinafter and that will form the subject matter of the claims appended hereto. It is to be understood that the phraseology and terminology employed herein are for the purpose of description and should not be regarded as limiting.

BRIEF DESCRIPTION OF FIGURES

Various objectives, features, and advantages of the disclosed subject matter can be more fully appreciated with reference to the following detailed description of the disclosed subject matter when considered in connection with the following drawings, in which like reference numerals identify like elements.

DETAILED DESCRIPTION

Figure 1A:
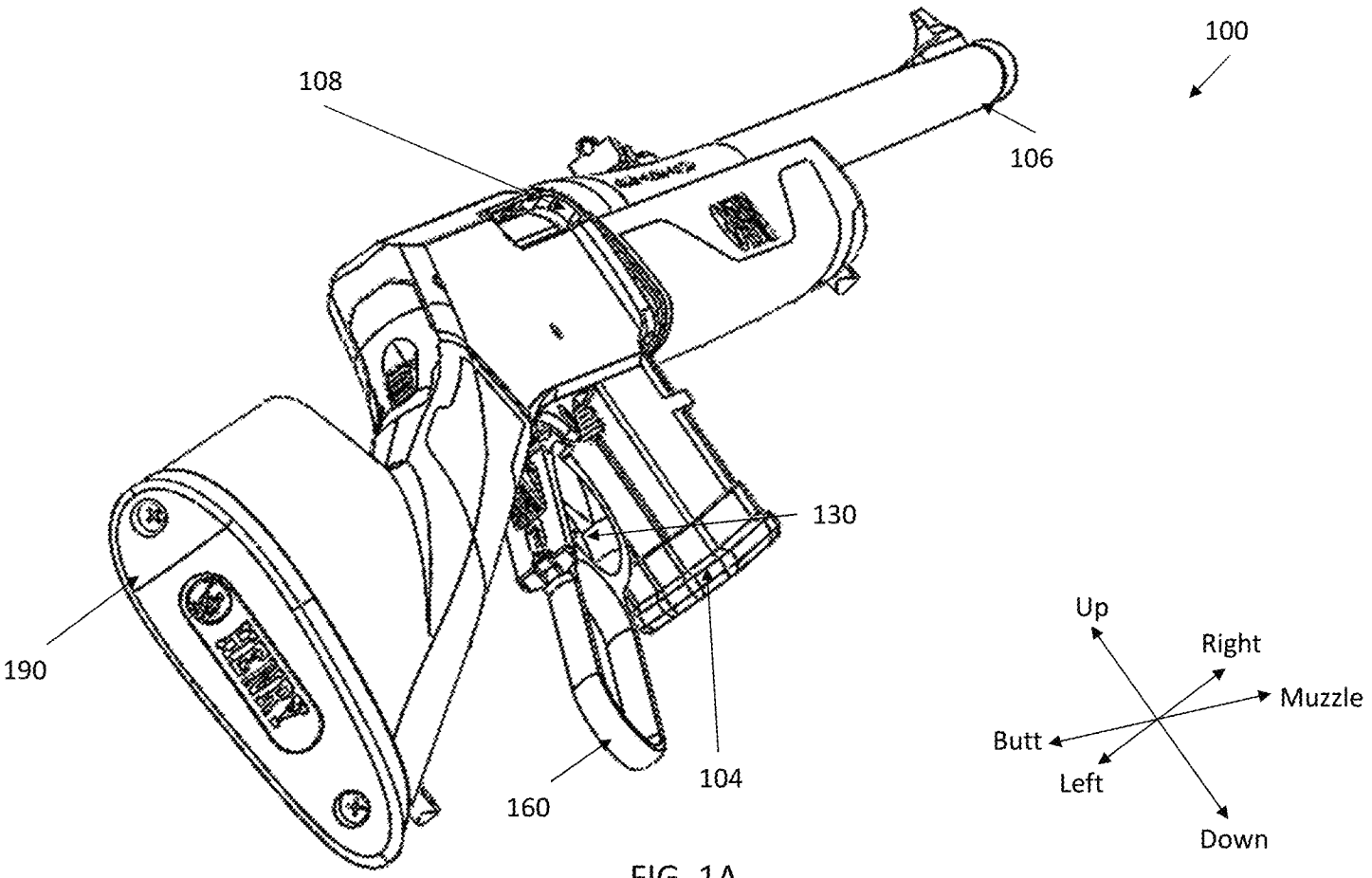
FIGS. 1A-1C are perspective diagrams of an exemplary lever action firearm, according to some embodiments.

The techniques described herein provide for firearm fire control mechanisms that are disposed within a firearm. The fire control mechanisms allow a firearm user to prevent firing of the firearm via mechanical interaction of the mechanisms with the firing pin. The fire control mechanisms described herein include, for example, safety mechanisms, trigger adjustment mechanisms, and other mechanisms that interact with the components used to operate the firearm (e.g., the trigger, sear, hammer, lever, etc.). In some examples described herein, the techniques will be referred to as a fire control mechanism generally, without intending to be limiting.

The inventor has appreciated deficiencies with conventional fire control mechanisms. In particular, the inventor has appreciated that various types of firearms have fire control mechanisms that could have a smoother trigger pull feel perceived by the user, without reducing safety. Conventionally, safety or cost savings are given up in order to attain these goals. For example, in a conventional firearm where the trigger is not balanced about its axis, or in some conventional firearms where the sear can be actuated independently of the trigger, causing the hammer to drop.

Some conventional approaches have tried leveraging complex techniques to allay some of these problems. However, such approaches are typically expensive to manufacture and thus are not viable commercial solutions. Additionally, such approaches introduce complexity and/or unexpected change at the user end, which is also not desirable (e.g., due to user preferences, consistency of functionality, the need for training, etc.).

Accordingly, the inventor recognized and appreciated that safer, longer lasting, low cost, and user-friendly fire control mechanisms can be achieved using techniques and embodiments described herein. For example, the inventor has appreciated that a fire control mechanism may be fit in a smaller volume but still have an internal bolt and hammer. Some embodiments allow for low trigger pull force with very little creep and limited over-travel of the trigger.

The techniques described herein address the above deficiencies and others. The techniques provide for a fire control mechanism that includes a safety bar configured to engage with a safety selector and with a sear and to transition between a first safety configuration and a second safety configuration, and a sear configured to engage with the trigger and to transition between a first sear configuration and a second sear configuration. In some embodiments, in the first safety configuration, the safety bar is engaged with the safety selector such that the safety bar is engaged with the trigger to prevent the sear from being actuated, and in the second safety configuration, the safety bar is engaged with the safety selector such that the safety bar is not engaged with the trigger, thereby allowing the trigger to be actuated to move the sear from the first sear configuration to the second sear configuration. In some embodiments, in the first sear configuration, the sear or trigger is engaged with a hammer to prevent the hammer from being released to fire the firearm, and in the second sear configuration, the sear does not prevent the hammer from being released to fire the firearm.

The techniques described herein can therefore provide safer, longer lasting, low cost, and/or user-friendly fire control mechanisms, which can address issues with conventional techniques. For example, the techniques described herein allow the safety selector to be provided on the tang of the firearm and operated in the same manner as some conventional safeties (e.g., by moving the safety towards or away from the muzzle of the firearm). Accordingly, the safety selector can provide users with desired and/or consistent operation as expected based on the operation of some conventional safeties. However, the internal working components are different than those of conventional safeties, as further described herein (e.g., including the use of a curved shaped path in the safety bar that interacts with the safety selector).

As another example, the techniques can allow a user to easily customize aspects of the firearm trigger, such as the trigger pull force (e.g., the force required to press or move the trigger), trigger creep (e.g., the amount of distance the trigger can move prior to firing the firearm), and/or trigger overtravel (e.g., the amount the trigger may move after firing the firearm).

As a further example, as described herein, the mechanical interaction of the sear with the trigger can be implemented using a balanced trigger configuration that mechanically interacts with the sear and has little friction with the sear (e.g., rather than using a latch-style configuration as with conventional techniques, such as with the hammer interacting with the sear, which can have a lot of friction). The techniques described herein can also achieve a safe firearm while using a low sear force by using a configuration in which the sear engages with the trigger via a force that is transmitted by the sear onto the trigger in the direction of the pivot axis of the trigger (e.g., rather than away from the direction of the pivot axis, as with conventional techniques). Such a force that resists the pull of a trigger can be implemented using, for example, a higher trigger spring, which can be controlled to provide for a controllable trigger force (e.g., via screw adjustment, rather than requiring changes to the angle/geometry of the firearm components) in combination with the low frictional force of the sear interacting with the trigger, which stands in contrast to conventional techniques that use a generally higher frictional force between the sear and the trigger with a relatively low trigger "return spring" force.

In some embodiments, the sear engages the hammer using a protrusion on the sear (e.g., a lobe of the sear, as described herein). Such a configuration is different than some conventional approaches, such as those that use a hook-shape interaction between the sear and the hammer. In some embodiments, the sear can have a protrusion that prevents the sear from lifting when firing, since the sear would be countered by a protrusion of the hammer and/or the hammer spring. As a result, in some embodiments the hammer can reset the sear, as described herein.

In some embodiments, the techniques can leverage components that are manufactured using diecasting. Such diecast components can include, for example, a diecast lower receiver (or trigger guard).

In the following description, numerous specific details are set forth regarding the systems and methods of the disclosed subject matter and the environment in which such systems and methods may operate, etc., in order to provide a thorough understanding of the disclosed subject matter. In addition, it will be understood that the examples provided below are exemplary, and that it is contemplated that there are other systems and methods that are within the scope of the disclosed subject matter.

Figure 1B:
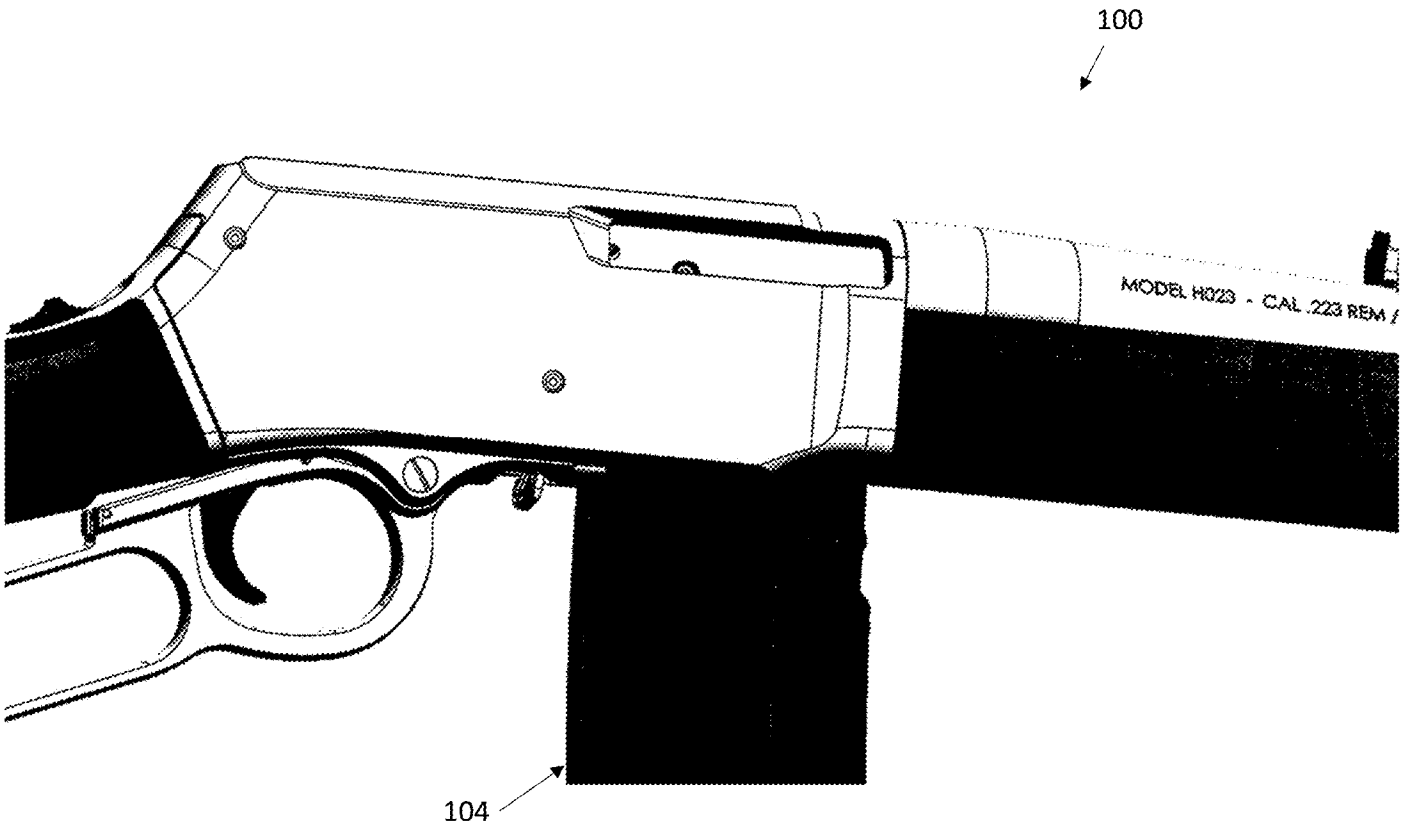
Figure 1C:
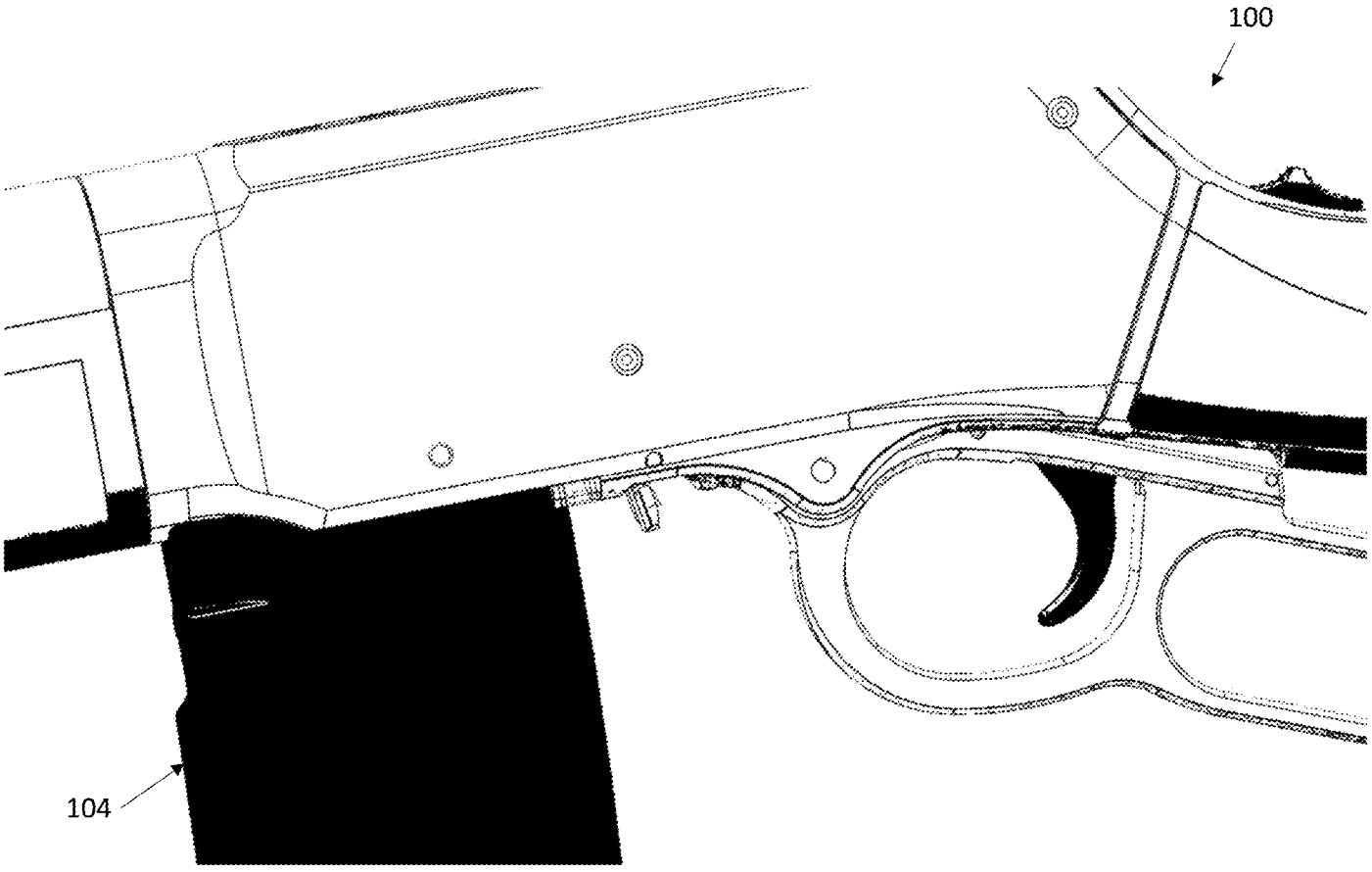

FIGS. 1A-1C are perspective diagrams of an exemplary firearm 100, according to some embodiments. The firearm 100 includes a magazine 104 that can be loaded into (and released from) the firearm 100. The magazine 104 is configured to hold a set (e.g., five, ten, fifteen, twenty, thirty, etc.) of cartridges (not shown) for use with the firearm 100. Each cartridge includes a casing (or shell, such as in the case of a shotgun), a projectile(s) disposed at a proximal end of the casing (e.g., bullet, shot, slug, etc.), a fuse disposed at a distal end of the casing, and an explosive disposed within a portion of the casing between the fuse and the projectile.

The firearm 100 further includes a barrel 106 and a chamber 108 (not visible, internal to the barrel) disposed adjacent to the barrel and sized to receive a cartridge. In some embodiments, the firearm is a lever action firearm. For example, the firearm 100 may include a lever 160 that, when actuated by the user, loads a cartridge into the chamber 108 and/or unloads a cartridge from the chamber. The firearm 100 also includes a firing pin assembly and/or firing pin (not shown) that is mechanically actuatable by the trigger 130, such that upon actuation, the firing pin is configured to contact the fuse of the cartridge loaded into the chamber 108 to ignite the explosive and to cause the projectile(s) to be expelled through the barrel 106 of the firearm 100.

Figure 2:
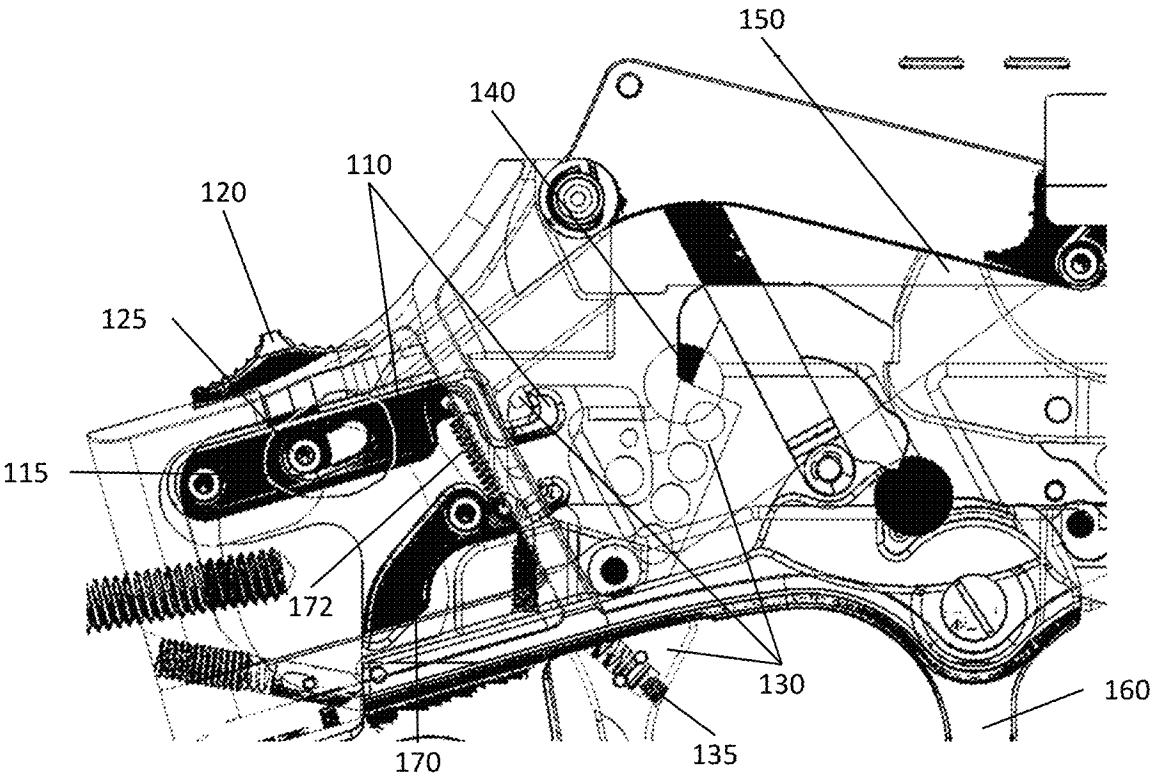
FIG. 2 is a plan view diagram of exemplary components of fire control mechanisms, according to some embodiments.

FIG. 2 is a plan view diagram of exemplary components of fire control mechanisms, according to some embodiments. In some embodiments, the firearm is a lever action firearm. FIG. 2 shows safety bar 110 with a hooked end, safety selector 120 mounted on the tang of the firearm, trigger 130, sear 140, hammer 150, lever 160, pivoter 170 (which may be referred to as "trigger lock"), region 115 of the safety bar 110, portion 125 of the safety selector 120, and screw 135.

Figure 3:
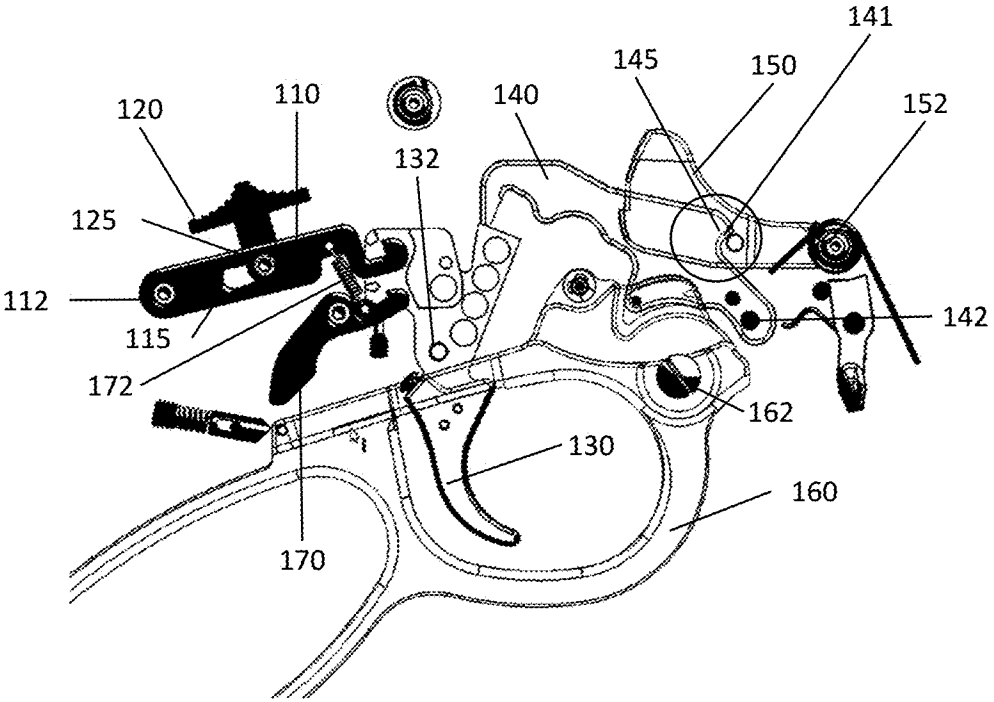
FIG. 3 is an exposed plan view diagram of alternative exemplary components of fire control mechanisms, according to some embodiments.

In some embodiments, safety bar 110 may be configured to engage with the safety selector 120 and with the trigger 130. Additionally, the safety bar 110 may be configured to transition between a first safety configuration in which safety is "on" (safety-on) and a second safety configuration in which safety is "off" (safety-off). For example, FIG. 2 shows the first safety configuration (safety-on) with the safety selector 120 moved towards the butt of the firearm, and FIG. 3 shows the second safety configuration (safety-off) with the safety selector 120 moved towards the muzzle of the firearm.

Figure 4A:
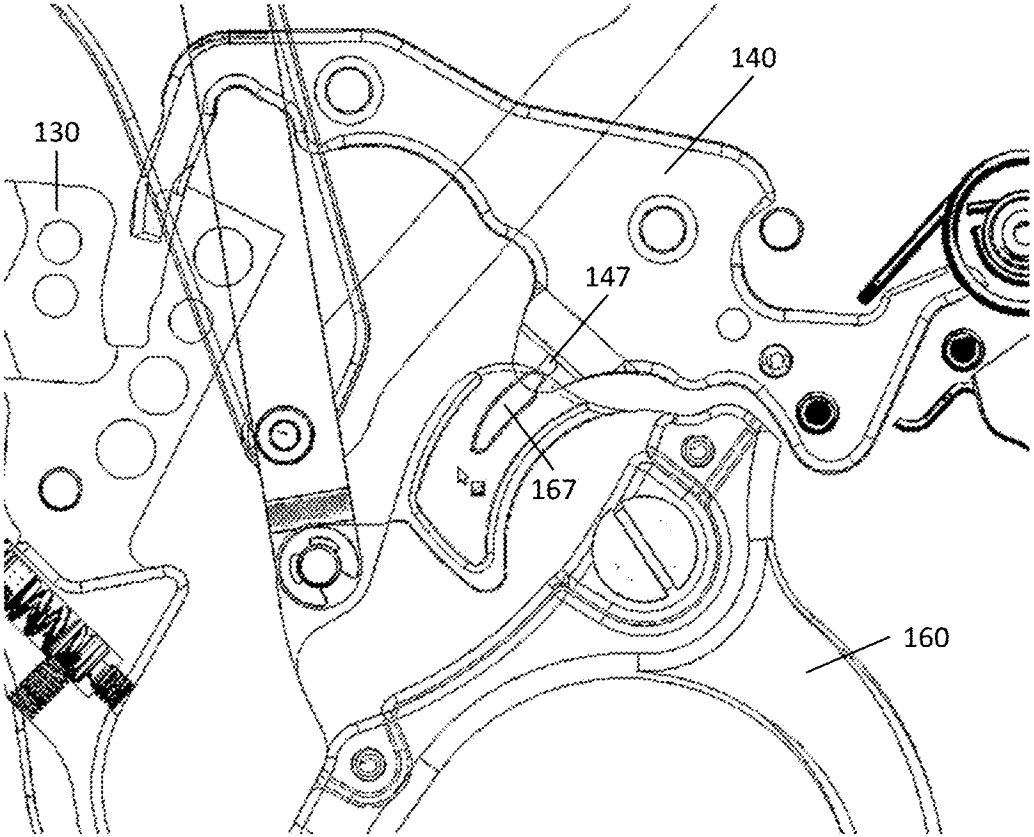
FIG. 4A is an additional exposed plan view diagram of exemplary components of fire control mechanisms, including with the sear transitioning between configurations, according to some embodiments.
Figure 4B:
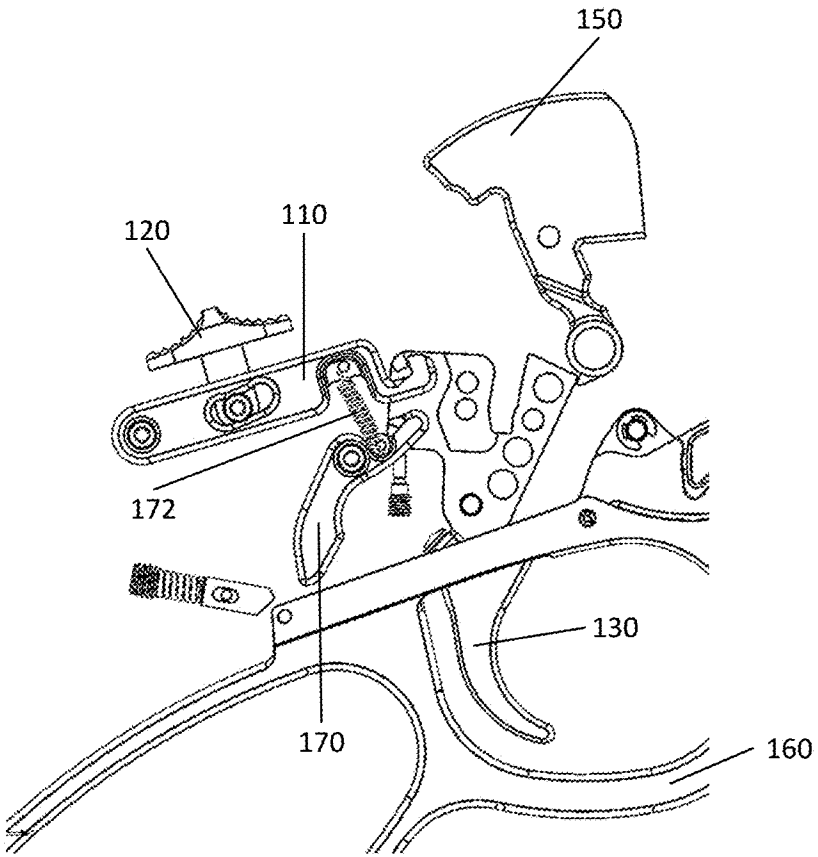
FIG. 4B is an exposed plan view diagram of exemplary components of fire control mechanisms without a sear, according to some embodiments.
Figure 4C:
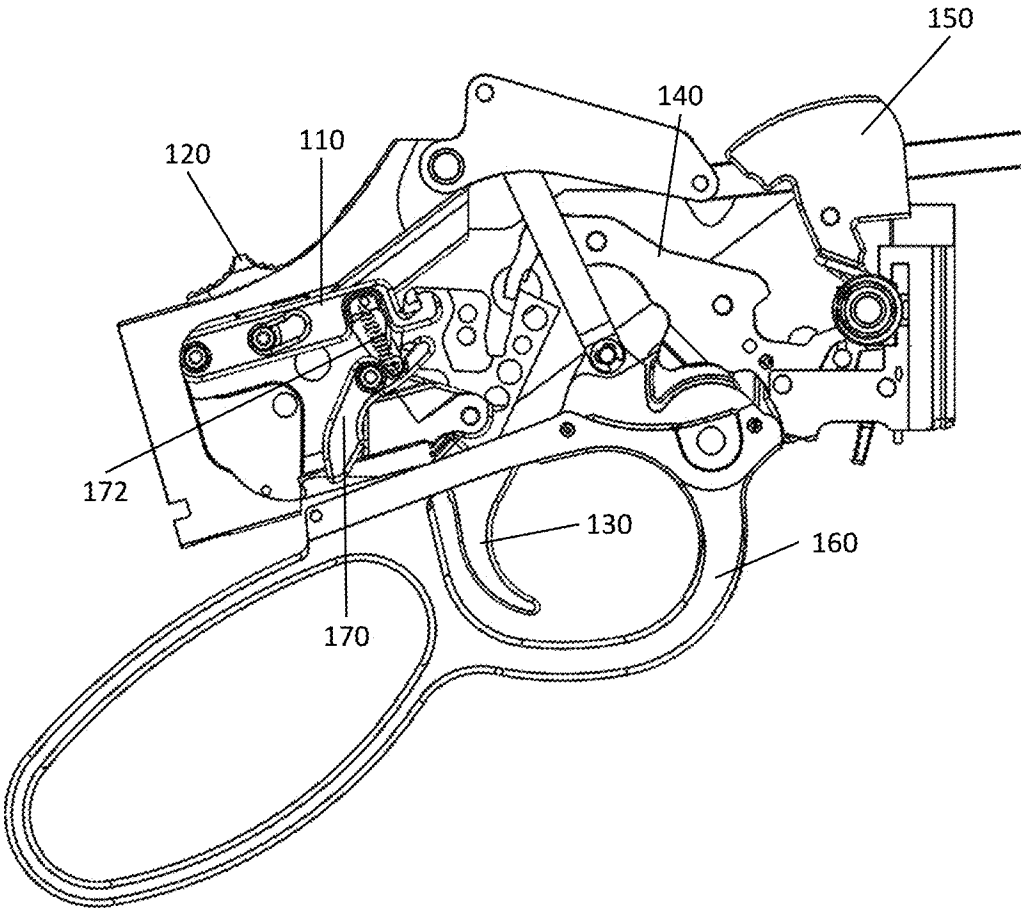
FIG. 4C is an exposed plan view diagram of exemplary components of fire control mechanisms with a partially open lever, according to some embodiments.
Figure 4D:
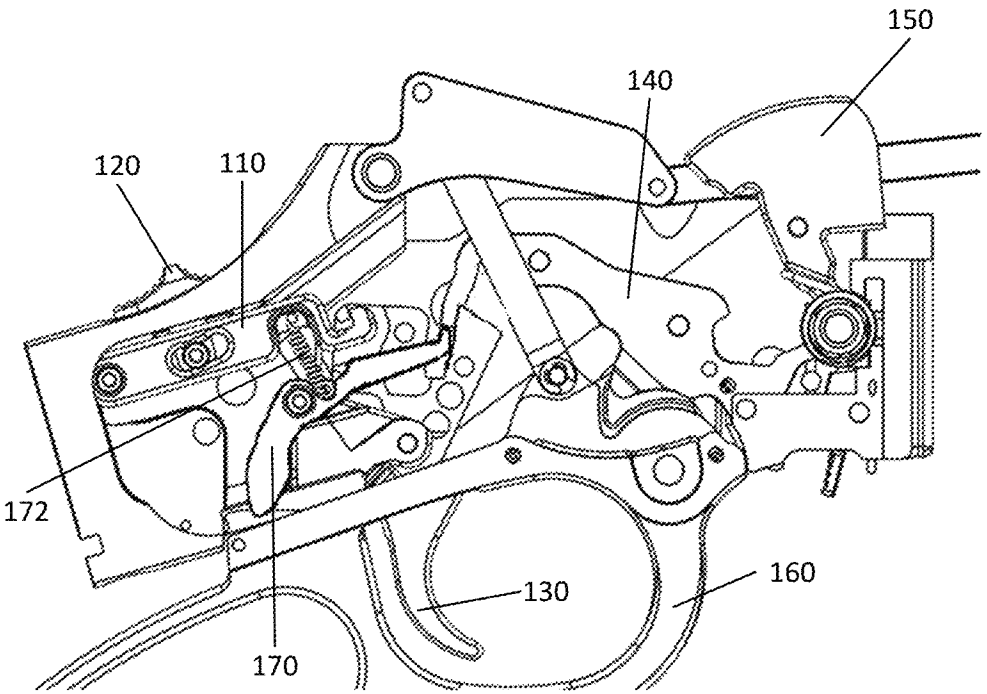
FIG. 4D is an exposed plan view diagram of exemplary components of fire control mechanisms with a pivoter engaging a sear, according to some embodiments.
Figure 4E:
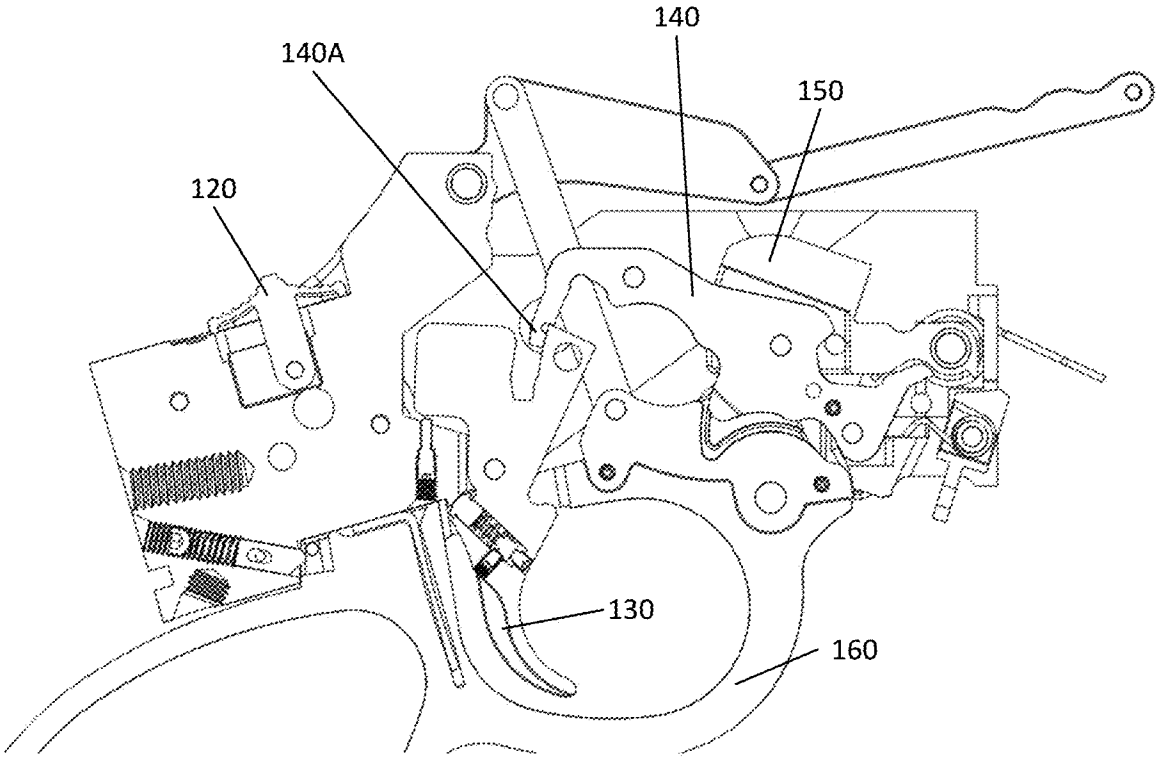
FIG. 4E is an exposed plan view diagram of exemplary components of fire control mechanisms with a sear in the unfired position, according to some embodiments.
Figure 4F:
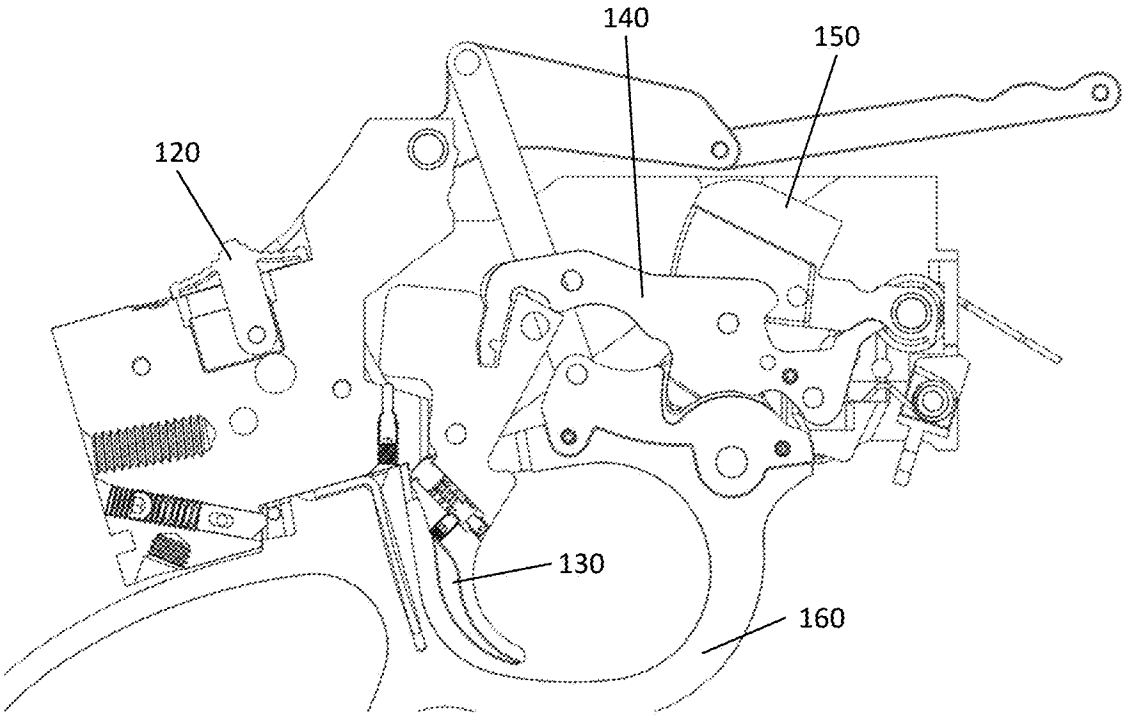
FIG. 4F is an exposed plan view diagram of exemplary components of fire control mechanisms with the sear and trigger in the fired position, but the hammer not in the fired position, according to some embodiments.

In some embodiments, the sear 140 may be configured to engage with the trigger 130. For example, FIG. 3 and FIG. 4A show a sear 140 engaging with a trigger 130 in different configurations. Additionally, the sear 140 may be configured to transition between a first sear configuration in which the firearm is not meant to be able to fire (no fire), and a second sear configuration in which the firearm is meant to be able to fire (fire). For example, FIG. 3 shows the first sear configuration in which the firearm is not firing (no fire), FIG. 4A shows the transition between the first and second sear configuration in which the firearm is firing (fire), and FIG. 4F shows the second sear configuration in which the firearm is firing (fire). In some embodiments, the sear 140 may be completely separate from the trigger 130, as shown in FIGS. 2-4A. FIG. 4E shows another exemplary design of the sear 140, where the sear includes a tab 140A that hang over the trigger. The tab 140A can prevent the trigger from being released too far when in the unfired position (e.g., which can reduce trigger creep).

In some embodiments, in the first safety configuration (safety-on), the safety bar 110 may be engaged with the safety selector 120 (e.g., via a hook of the safety bar 110, which engages a protrusion of the trigger 130) such that the safety bar 110 is engaged with the trigger 130, to prevent the trigger 130 from being actuated. For example, FIG. 2 shows the trigger 130 held in place by the safety bar 110 because of the rearward position of the selector 120.

In some embodiments, in the second safety configuration (safety-off), the safety bar 110 may be engaged with the safety selector 120 such that the safety bar 110 is moved away from, and thus not engaged with, the trigger 130, thereby allowing the trigger 130 to be actuated to move the sear 140 from the first sear configuration (no fire), to the second sear configuration (fire). For example, FIG. 3 shows that the trigger 130 is not held in place by the safety bar 110, but rather is free to pivot around axis 132 because of the different position of the selector 120. Once the trigger 130 is pressed by the operator, the trigger 130 rotates around pivot axis 132, allowing the sear 140 to drop downwards towards the trigger 130, firing the firearm (as described further below).

In some embodiments, the safety bar 110 may be configured to transition between the first safety configuration (safety-on) and the second safety configuration (safety-off) by pivoting around a first axis 112 (such as is shown in FIG. 3, via a pivot point at 112).

In some embodiments, in the first sear configuration (no fire), the sear 140 is engaged with the hammer 150 to prevent the hammer 150 from being released to fire the firearm. In some embodiments, in the second sear configuration (fire), the sear 140 does not prevent the hammer 150 from being released to fire the firearm, and therefore the hammer 150 swings upward to fire the firearm.

While FIGS. 2 and 3 show a spring connected to the safety bar 110, in some embodiments the spring may only be used to hold the safety bar 110 for firing the firearm, not to keep it safe. Accordingly, in some embodiments, a spring is not needed to keep the firearm's safety functional, unlike some conventional firearms. For example, if the spring broke, the firearm would remain in the safe position, which can be desirable for safe firearm operation (e.g., in the event the spring weakens, breaks, etc.).

In some embodiments, the firearm may comprise a safety bar 110 configured to engage with a safety selector 120 and with one or more fire control components, and to transition between at least two selector configurations. For example, the at least two selector configurations may include a first selector configuration (safety-on) and a second selector configuration (safety-off). In some embodiments, the one or more fire control components may include a trigger 130 or any other suitable component. In some embodiments, the safety bar 110 may be used to select between semi-automatic-fire and fully-automatic-fire, or between semi-automatic-fire and burst-fire. For example, different notches at different positions of the safety bar 110 could be used to transition between these different modes of fire.

In some embodiments, the firearm may comprise a safety bar 110 configured to engage with a safety selector 120 and with a sear 140. In some embodiments, the sear 140 may be responsible for releasing stored energy required to fire a projectile from a firearm. In some embodiments, the sear 140 may release a striker (e.g., instead of a hammer 150). In some embodiments, for firearms with electronic fire control groups, the sear 140 may release stored potential energy by completing a circuit, at which point the potential energy may convert into electrical energy to ignite the primer. In some embodiments, such as for railguns, there may be no gun powder or case, but the projectile may be electronically accelerated down the barrel. In some embodiments, the sear 140 may be a feature on the trigger 130 that releases the hammer or striker.

In some embodiments, the sear 140 may be an assembly. In some embodiments, the firing pin may be an assembly. In some embodiments, the striker may be an assembly. In some embodiments, the trigger may be an assembly.

In some embodiments, the safety bar 110 may interact with the sear 140. For example, the safety bar 110 may be configured to engage with the safety selector 120 and with sear 140 (for example, instead of or in addition to trigger 130), and to transition between the first safety configuration (safety-on) and the second safety configuration (safety-off). In some embodiments, the sear 140 may still be configured to engage with trigger 130 and to transition between a first sear configuration (no-fire) and a second sear configuration (fire) when the safety bar 110 interacts with the sear 140.

Figure 4G:
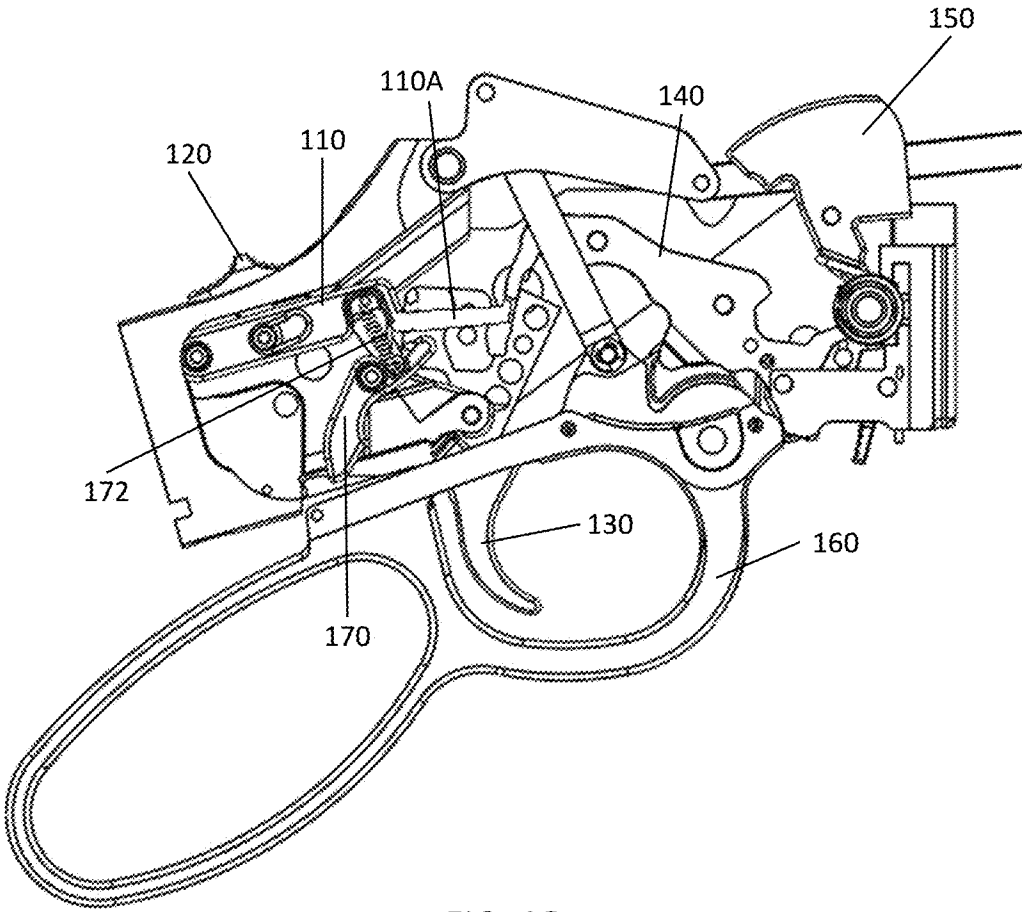
FIG. 4G is an exposed plan view diagram of exemplary components of fire control mechanisms with a safety bar engaging a sear, according to some embodiments.

In some embodiments, in the first safety configuration (safety-on), the safety bar 110 may be engaged with the safety selector 120 at a first position. As a result, the safety bar 110 may be engaged with the sear 140 to prevent the sear 140 from being actuated, as shown in FIG. 4G. FIG. 4G shows the safety bar 110 with an elongated portion 110A that extends outwards (in a direction that is away from the butt of the firearm) such that the elongated portion 110 mechanically contacts the sear 140 when the safety selector 120 is at the first position.

In some embodiments, in the second safety configuration (safety-off), the safety bar 110 may be engaged with the safety selector 120 at a second position, such that the safety bar 110 is not engaged with the sear 140. As a result, the trigger 130 may be allowed to be actuated to move the sear 140 from the first sear configuration (no-fire) to the second sear configuration (fire).

In some embodiments, in the first sear configuration (no-fire), the sear 140 or trigger 130 may be engaged with a hammer 150 to prevent the hammer 150 from being released to fire the firearm. In some embodiments, in the second sear configuration (fire), the sear 140 does not prevent the hammer 150 from being released to fire the firearm.

In some embodiments, the lever 160 may engage with the sear 140 to reset the sear 140. For example, in the second sear configuration (fire), the sear 140 may be configured to be engaged by a first surface of a lever 160 such that the sear 140 may be transitioned to the first sear configuration (no-fire).

In some embodiments, a portion of the lever (e.g., a wedge-shaped protrusion or component of the lever) may interact with a portion of the sear (e.g., a D-shaped protrusion or component of the sear). For example, the lever 160 may include a feature 167 and the sear 140 may include a feature 147. In some embodiments, feature 167 may be a boss, such as a wedge-shaped boss. In some embodiments, feature 167 may have an inverted shape. In some embodiments, feature 147 may be a boss, such as a D-shaped boss. In some embodiments, feature 147 may have an inverted shape.

FIG. 4A shows examples of a lever 160 and its feature 167, a sear 140 and its feature 147, as well as a trigger 130. In some embodiments, the feature 167 of the lever 160 may be configured to engage with the feature 147 of the sear 140, while the sear 140 is in the second sear configuration (fire).

As a result, the sear 140 may be prevented from remaining in between the second sear configuration (fire) and the first sear configuration (no-fire).

The inventor has recognized and appreciated that conventionally, without such a lever and sear interaction (e.g., via wedge-shaped or similar components), a user could unintentionally create a (dangerous) hair trigger. In particular, a user could have the lever partly open, creating normal force between the sear and trigger. As a result, the user could close the lever and create the hair trigger with only friction holding the sear up and in place. As a result, a configuration such as that between the lever and sear described herein can avoid such a hair trigger.

In some embodiments, the fire control mechanisms described herein, including the safety bar 110, may operate without a sear 140. FIG. 4B shows an example without a sear 140. For example, a fire control mechanism may instead use a surface of the trigger 130 that is directly part of the trigger 130 to function as the sear. The inventor has recognized and appreciated that such a configuration may eliminate the need for a separate sear 140, which may reduce cost, complexity, weight, risk, and/or the like.

In some embodiments, the safety bar 110 can provide safety-on and safety-off configurations for embodiments that do not use a sear. For example, the safety bar 110 may be configured to engage with a safety selector 120 and with the trigger 130 and to transition between a first safety configuration (safety-on) and a second safety configuration (safety-off). In some embodiments, in the first safety configuration (safety-on), the safety bar 110 may be engaged with the safety selector 120 such that the safety bar 110 is engaged with the trigger 130 to prevent the trigger 130 from being actuated. In some embodiments, in the second safety configuration (safety-off), the safety bar 110 is engaged with the safety selector 120 such that the safety bar 110 is not engaged with the trigger 130. As a result, the trigger 130 may be allowed to be actuated to move the sear surface of the trigger 130 from the first trigger configuration (no-fire) to the second trigger configuration (fire).

In some embodiments, in the first trigger configuration (no-fire), the sear surface of the trigger 130 is engaged with a hammer 150 to prevent the hammer 150 from being released to fire the firearm. In some embodiments, in the second trigger configuration (fire), the sear surface of the trigger 130 does not prevent the hammer 150 from being released to fire the firearm.

In some embodiments, a safety bar 110 may include a region 115 (e.g., a cutout) via which it may interact with a portion 125 (e.g., a pin) of the safety selector 120. For example, in some embodiments, the safety bar 110 may include the region 115, which may be configured to receive a portion 125 of the safety selector 120, and the safety bar 110 may be configured to engage with the safety selector 120 via the region 115 and the portion 125. FIGS. 2 and 3 show safety selector 120 and safety bar 110 moving relative to each other and interacting via the region 115 (here a cutout) and the portion 125 (in this exemplary embodiment, a pin). In some embodiments, the movement of the safety selector 120 causes the portion 125 of the safety selector 120 to slide along the region 115 of the safety bar 110.

In some embodiments, the safety bar 110 may be configured to engage with the safety selector 120 and with a trigger 130 or sear 140, and to transition between a first safety configuration (safety-on) and a second safety configuration (safety-off).

In some embodiments, in the first safety configuration (safety-on), the safety bar 110 is engaged with the safety selector 120 such that the safety bar 110 is engaged with the trigger 130 or sear 140, to prevent the trigger 130 from being actuated and/or to prevent the sear 140 from releasing the hammer 150 to fire the firearm.

In some embodiments, in the second safety configuration (safety-off), the safety bar 110 is engaged with the safety selector 120 such that the safety bar 110 is not engaged with the trigger 130 or sear 140. As a result, the trigger 130 may be allowed to be actuated and/or the sear 140 may be allowed to release the hammer 150, which may result in firing the firearm.

In some embodiments, the region 115 (e.g., a cutout) may have a particular shape or profile. For example, the region 115 may be symmetric across a first plane orthogonal to a primary direction of travel of the portion 125 through the region 115. However, the techniques are not so limited, as the region 115 may be asymmetric across the first plane (e.g., with one detent notch being deeper than the other, the shape of the flat section could be curved, V-shaped, and/or the like). Additionally, the region 115 may be asymmetric across a second plane orthogonal to the first plane and to the primary direction of travel. For example, the primary direction of travel in FIGS. 2 and 3 is approximately right-left (with an angle offset), and here region 115 is symmetric across a plane orthogonal to that and asymmetric across a plane orthogonal to both (e.g., symmetric from approximately left to right and symmetric from approximately top to bottom).

In some embodiments, the region 115 may include a first end of the primary direction of travel and a second end of the primary direction of travel, and a first notch at a top portion of the first end and a second notch at a top portion of the second end. For example, the region 115 may be bean-shaped, as shown in FIGS. 2 and 3. However, it should be appreciated that this is for exemplary purposes only, and the techniques are not so limited. For example, the first notch and/or the second notch may be at the bottom portions of the first and second ends, respectively. In some embodiments, trigger 130 or sear 140 may interact with pivoter 170. For example, in some embodiments, the pivoter 170 may be configured to engage with the trigger 130 or the sear 140 and to transition between a first pivoter configuration (engaged) and a second pivoter configuration (disengaged).

In some embodiments, in the first pivoter configuration (engaged), the pivoter 170 may be engaged with the trigger 130 to prevent the trigger 130 from being actuated when the lever 160 is open. This can occur, for example, when the lever 160 is at least partially open as shown in FIG. 4C.

In some embodiments, in the second pivoter configuration (disengaged), the pivoter 170 is not engaged with the trigger 130, allowing the trigger 130 to be actuated, when the lever 160 is closed. For example, FIGS. 2 and 3 show the second pivoter configuration, as the pivoter 170 there is not hooked around a part of the trigger 130.

In some embodiments, the pivoter 170 may be engaged with the sear 140 when the lever 160 is open to prevent the sear 140 from being actuated.

In some embodiments, the fire control mechanism may include at least one spring. For example, in some embodiments, the safety bar 110 may be engaged with the pivoter 170 via a spring 172.

In some embodiments, a pivoter 170 may be configured to engage with a trigger 130 or sear 140 and to transition between a first pivoter configuration (engaged) and a second pivoter configuration (disengaged). For example, FIG. 4D shows a pivoter 170 engaging with sear 140. In some embodiments, in the first pivoter configuration (engaged), the pivoter 170 may be engaged with the sear 140 when the lever 160 is open, which may prevent the sear 140 from releasing the hammer 150 to fire the firearm. In some embodiments, in the second pivoter configuration (disengaged), the pivoter 170 may be not engaged with the sear 140 when the lever 160 is closed. As a result, the sear 140 may be allowed to release the hammer 150 to fire the firearm upon actuation of the trigger 130.

In some of these embodiments also, the pivoter 170 may be engaged with the sear 140 when the lever 160 is open to prevent the sear 140 from being actuated, and/or the safety bar 110 may be engaged with the pivoter 170 via a spring 172.

In some embodiments, the trigger 130 may create interference with the sear 140 to prevent firing of a hammer-fired firearm. For example, in some embodiments, the sear 140 may be configured to engage with the trigger 130 and to transition between a first sear configuration (no-fire) and a second sear configuration (fire).

In some embodiments, in the first sear configuration (no-fire), the sear 140 may be engaged with the hammer 150 to prevent the hammer 150 from being released to fire the firearm.

In some embodiments, in the second sear configuration (fire), the sear 140 may not prevent the hammer 150 from being released to fire the firearm.

In some embodiments, the sear 140 may be biased towards the second sear configuration (fire), but the sear 140 may be prevented from moving to the second sear configuration (fire) by the trigger 130 when the trigger 130 is in the "unpulled" (unactuated) position. Additionally, when the trigger 130 is actuated, the trigger 130 may move out of the way of the sear 140, allowing the sear 140 to move to the second sear configuration (fire).

Figure 5:
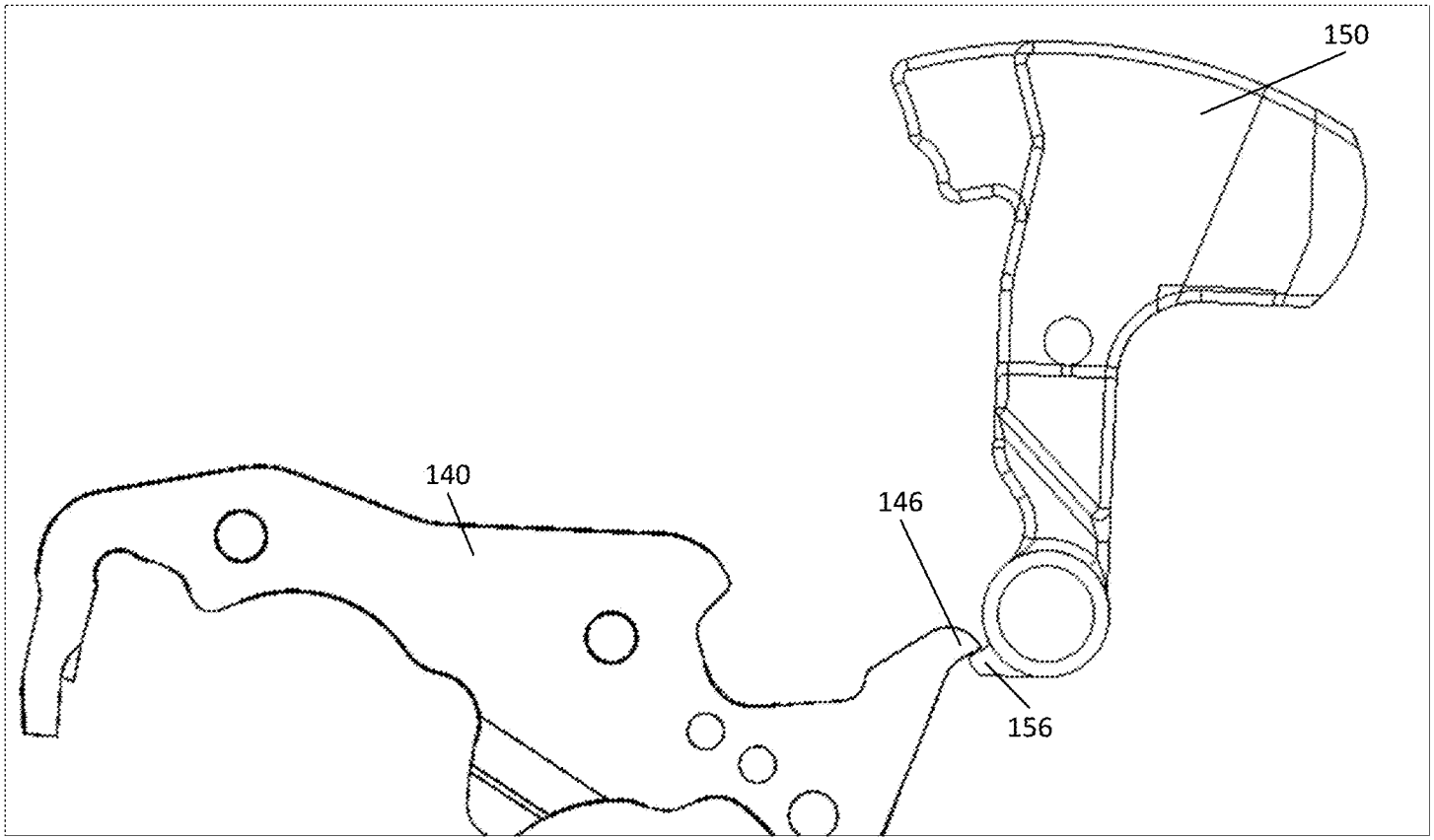
FIG. 5 is a plan view diagram of an exemplary interface between components of a fire control mechanism, according to some embodiments.

FIG. 5 is a plan view diagram of an exemplary interface between components of a fire control mechanism, according to some embodiments. These components may include sear 140, a protrusion 146 of the sear 140, a hammer 150, and a first protrusion 156 of the hammer 150.

In some embodiments, the hammer 150 may engage with the sear 140 for recoil protection. For example, the sear 140 may be configured to be engaged by the hammer 150 via a protrusion 146 of the sear 140 and a first protrusion 156 of the hammer 150. As a result, the sear 140 may be prevented from transitioning to the first sear configuration (no-fire) until the hammer 150 is transitioned towards an unreleased position.

The inventor has recognized and appreciated that conventionally, recoil of a firearm could cause the sear to prevent the hammer from cocking. For example, due to its center of mass being near the middle of the sear, firearm recoil could lift the sear on its own before the hammer was underneath the sear; as a result, the sear prevents cocking of the hammer because the sear is in the way of the hammer. The inventor has recognized and appreciated that in some embodiments, including a protrusion (like protrusion 156) on the sear 140 may prevent the sear 140 from lifting (or staying lifted), because the sear 140 may engage with the protrusion 156 on the hammer 150.

In some embodiments, the user can adjust the hammer 150 with the trigger guard out of the firearm. The inventor has recognized and appreciated that this may help reassemble the firearm. In some embodiments, the user can push the hammer 150 down with the firearm disassembled, which lifts the sear 140 up to reset the trigger 130 and get the usual "click" sound as often expected by the user.

In some embodiments, the sear 140 may move or be within a groove of the trigger 130 when the trigger 130 is actuated. For example, in the second sear configuration (fire), a first surface of the sear 140 may be between at least two surfaces of the trigger 130 (such as is shown in FIG. 4A). The inventor has recognized and appreciated that conventionally, a significant amount of friction is present between a sear and a trigger. In some embodiments herein, very little force may be needed on the sear 140, and the trigger 130 may be completely balanced around its center point. The inventor has recognized and appreciated that this can result in a much safer trigger 130 compared to conventional firearms (e.g., since the trigger 130 will not go off unexpectedly, as can occur with conventional firearms, such as if the firearm is dropped). In some conventional lever action firearms, the sear can be hooked onto the trigger or hammer to prevent movement of the hammer. In some embodiments as described herein, the sear 140 may engage the hammer 150 with a non-hook-shape. For example, as shown in FIG. 3, in the first sear configuration (no-fire), the sear 140 is configured to engage with the hammer 150 via a non-hook-shaped protrusion 145 of the sear 140 and a first surface 141 of the hammer 150 (such as is shown in FIG. 3). The inventor has recognized and appreciated that using such a non-hook-shape (e.g., a lobe-shape) may create smoother trigger pull compared to conventional techniques that rely on a hooked configuration.

Figure 6:
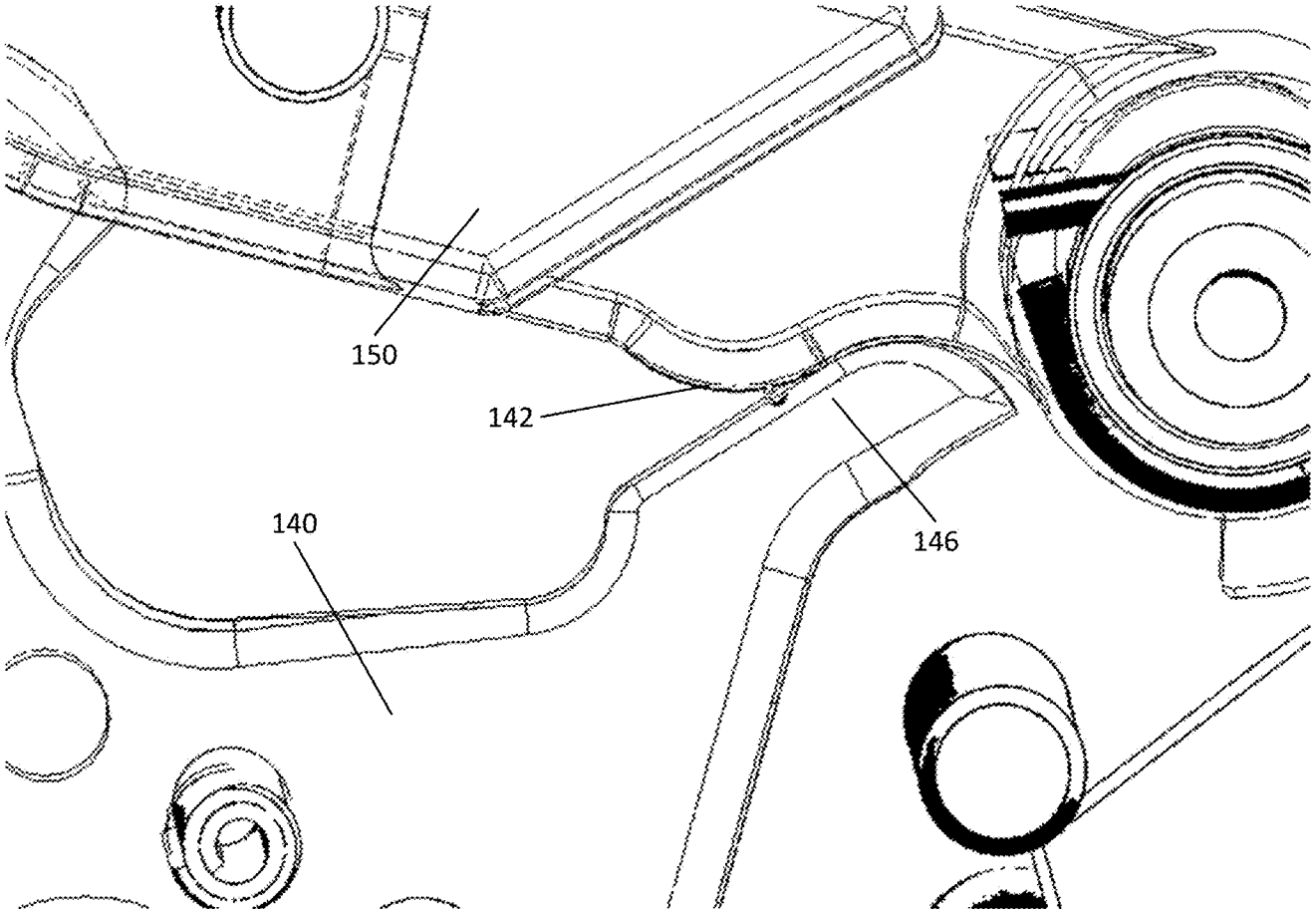
FIG. 6 is a plan view diagram of an additional exemplary interface between components of a fire control mechanism, according to some embodiments.

FIG. 6 is a plan view diagram of an additional exemplary interface between components of a fire control mechanism, according to some embodiments. These components may include sear 140, a protrusion 146 of the sear 140, hammer 150, and a second surface 142 of the hammer 150.

In some embodiments, the hammer 150 may engage with the sear 140 to reset the sear 140. For example, the sear 140 may be configured to be engaged by the hammer 150 via the additional protrusion 146 of the sear 140 and the second surface 142 of the hammer 150. As a result, the sear 140 may be transitioned to the first sear configuration (no-fire) by the second surface 142 of the hammer 150.

Figure 7:
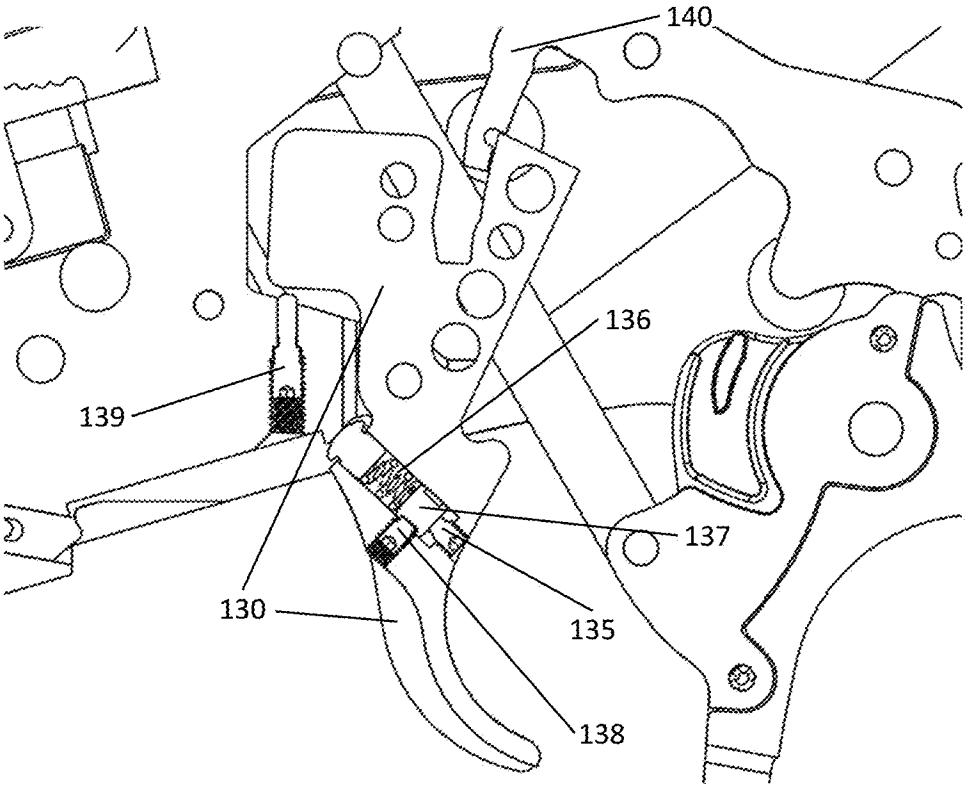
FIG. 7 is a plan view diagram of exemplary trigger adjustment mechanisms, according to some embodiments.

FIG. 7 is a plan view diagram of exemplary trigger adjustment mechanisms, according to some embodiments. In some embodiments, a dumbbell 137 may be employed for trigger adjustment. For example, in some embodiments, the trigger 130 may be configured to host a trigger force adjust screw 135 configured to adjust the pull force of the trigger 130 within a limit imposed by a dumbbell-shaped component 137. In some embodiments, a spring 136 may be used, such as that shown in FIG. 7. In some embodiments, the spring 136 may be pre-loaded by moving the dumbbell 137, which may be done by rotating the screw 135. In some embodiments, a screwable part 139 can be used to adjust creep of the trigger 130. For example, part 139 can be screwed inwards to reduce creep of the trigger 130 and/or screwed outwards to increase the creep of the trigger 130.

In some embodiments, a dumbbell limit screw 138 may limit how far the dumbbell 137 can be pushed in by the trigger force adjust screw 135 (as pushing too far can damage the spring 136), and the dumbbell limit screw 138 may prevent the dumbbell 137 from backing out too far (which reduces the trigger pull force to unsafe levels), even if the trigger force adjust screw 135 is completely removed. For example, as a user drives in screw 135, dumbbell 137 contacts limit screw 138 and thus dumbbell 137 cannot move farther. In some embodiments, one of the flanges of dumbbell 137 contacts an extended tip of screw 135, which may be what prevents further movement of dumbbell 137. In some embodiments, tamper-proof paint may be applied to monitor if a user moved the dumbbell 137 to an unsafe position.

In some embodiments, a tool may be embedded inside the lever 160. For example, the tool may be a hex key or Allen wrench, which may be used to adjust the trigger 130 and/or a front or rear sight.

In some embodiments, the sear 140 may engage the trigger 130 such that the force transmitted by the sear 140 onto the trigger 130 is in the direction of the trigger's pivot axis, rather than away from it. The inventor has recognized and appreciated that a force pointing towards the axis of the trigger means minimal force is required, whereas conventionally a spring force is pushing away from the action, requiring use of friction to hold a trigger and sear in place. As a result, in some embodiments, much less sear force is needed to be safe than conventional firearms. In some embodiments, instead of force on the trigger being transferred to the sear, most of the force on the trigger is transferred to a spring (such as spring 136). The inventor has recognized and appreciated that using a spring for this is much easier than conventional solutions because it has adjustable force resistance without requiring much more difficult changes in geometry.

Figure 8A:
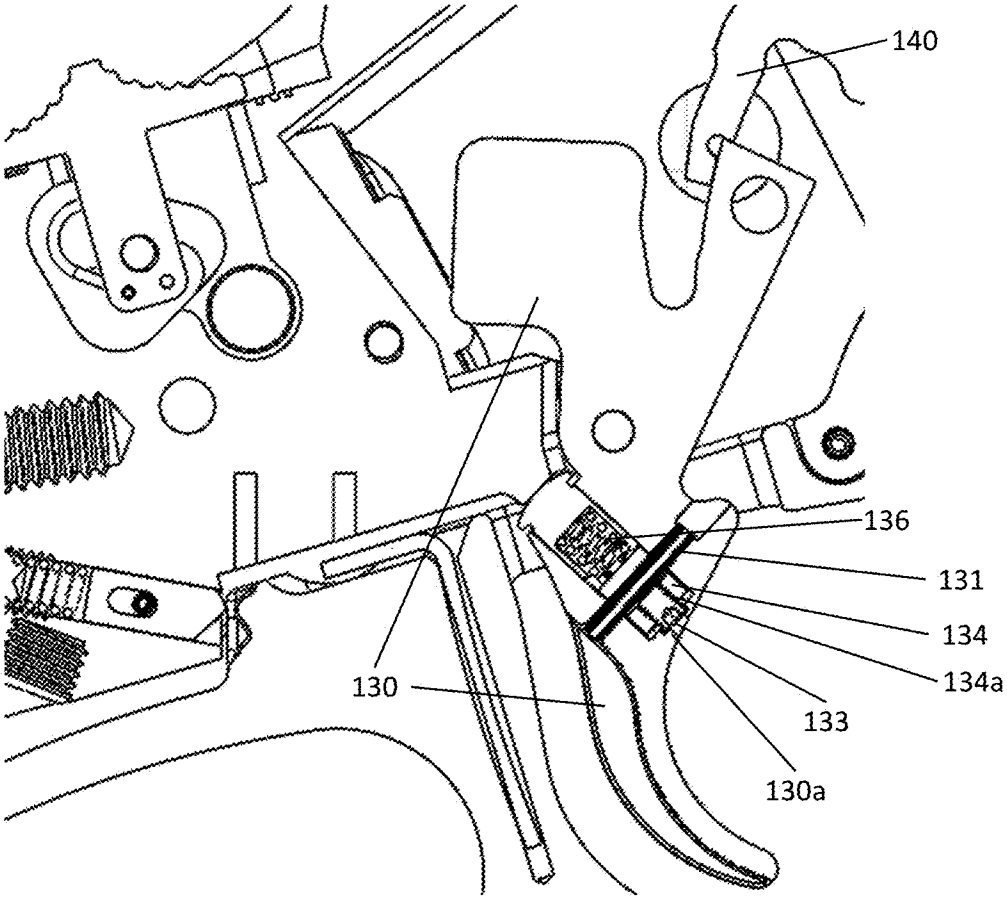
FIG. 8A is a plan view diagram of additional exemplary trigger adjustment mechanisms, according to some embodiments.
Figure 8B:
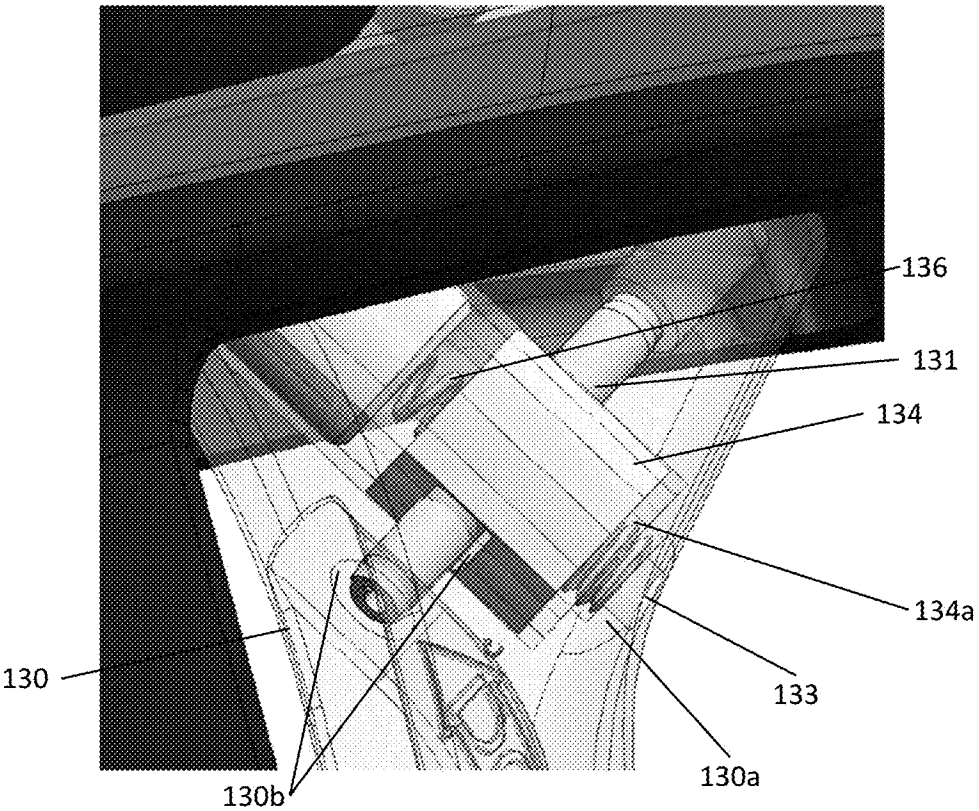
FIG. 8B is an additional plan view diagram of additional exemplary trigger adjustment mechanisms, according to some embodiments.
Figure 8C:
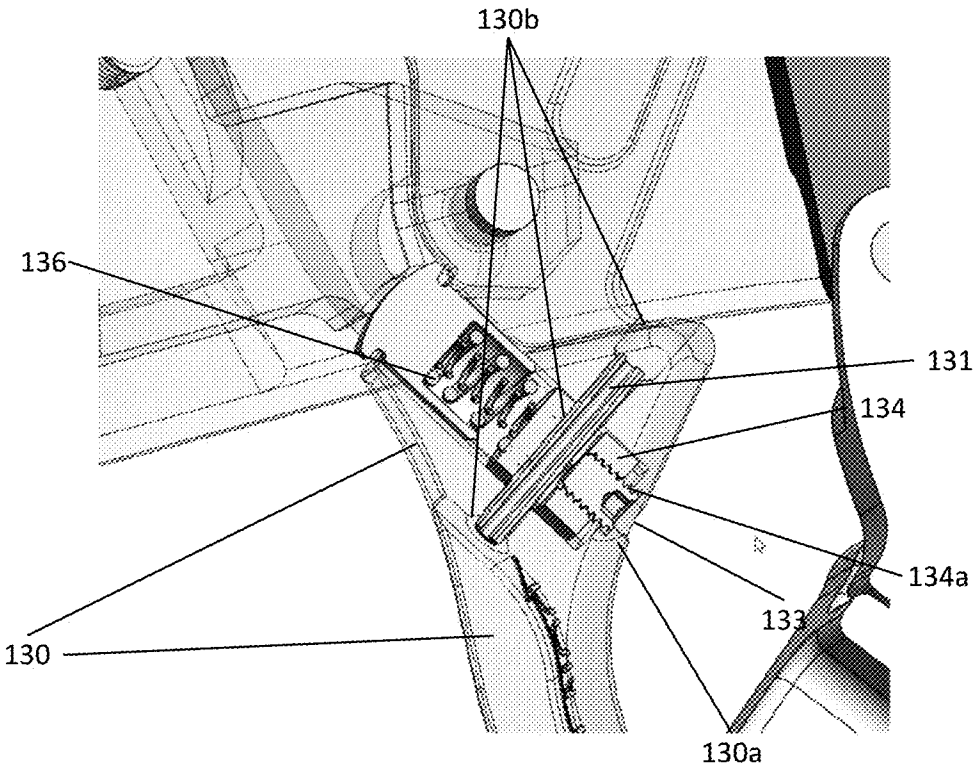
FIG. 8C is a further plan view diagram of additional exemplary trigger adjustment mechanisms, according to some embodiments.

FIGS. 8A-8C are plan view diagrams of additional exemplary trigger adjustment mechanisms, according to some embodiments. In some embodiments, trigger 130 may be configured to host or receive a cylinder-shaped component like a pin (e.g., a roll pin) 131, screw 133, and a nut 134 with a threaded portion 134*a*. In some embodiments, pin 131 may be used to control how much a user can adjust the trigger 130. For example, in some embodiments, the screw 133 can be used to adjust the pull force of the trigger 130 within a limit imposed by the pin 131 in combination with the nut 134. In some embodiments, threaded portion 134*a* interacts with the threads of the screw 133. For example, a user may turn the screw 133 in one direction to interact with the threaded portion 134*a* to drive the nut 134 away from the screw 133 to increase the trigger force. A user may turn the screw 133 in the opposite direction to move the nut 134 towards the screw 133 to decrease the trigger force. In some embodiments, a spring 136 may be used to create the adjustable trigger force, as shown in FIGS. 8A-8C. In some embodiments, the tension of the spring 136 may be increased (to increase the trigger force) or decreased (to decrease the trigger force) by rotating the screw 133 to move the nut 134 as described above.

In some embodiments, the pin 131 may be inserted into a slot 130*b* (as shown in FIGS. 8B-8C) that goes through both trigger 130 and components of the trigger adjustment mechanism, such as nut 134. The inventor has recognized and appreciated that the slot 130*b* can be sized so that the pin 131 can limit how far a user can adjust the nut 134 both when tightening the nut 134 (such that the pin will interact with a first side of the slot 130*b* when tightened to a maximum position) and loosening the nut 134 (such that the pin will interact with a second side of the slot 130*b* opposite the first side when loosened to a maximum position). As a result, the pin 131 can prevent a user from backing out the nut 134 and associated possible dangers with unsafe trigger force (as a user is unable to remove the pin when adjusting the trigger pull). As also shown in FIGS. 8A-8C, the trigger 130 can include a portion 130*a* that is sized smaller than the screw 133 but large enough for a user to adjust the screw 133 (e.g., large enough for an Allen key to pass through the portion). This portion 130*a* can allow the user to adjust the screw 133 while maintaining the screw 133 within the trigger 130.

In some embodiments, a left-hand screw 133 may be used so that turning the screw 133 to the right will move the nut 134 away from the screw 133 and, as a user would expect, tighten the trigger 130. Likewise, turning the screw 133 to the left will move the nut 134 towards the screw 133 and loosen the trigger 130. However, the techniques are not so limited and a right-hand screw 133 can also be used to provide for turning the screw 133 to the left to tighten the trigger 130 and turning the screw 133 to the right to loosen the trigger 130.

Figure 9B:
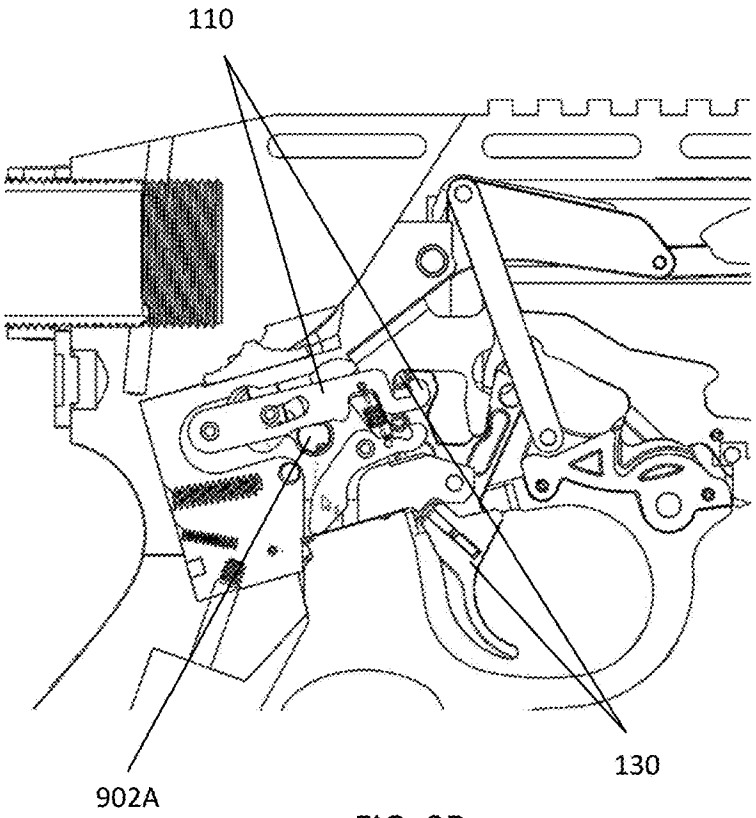
FIGS. 9A-9B are plan view diagrams of exemplary components of fire control mechanisms with a side-mounted safety selector in a first safety configuration, according to some embodiments.
Figure 9A:
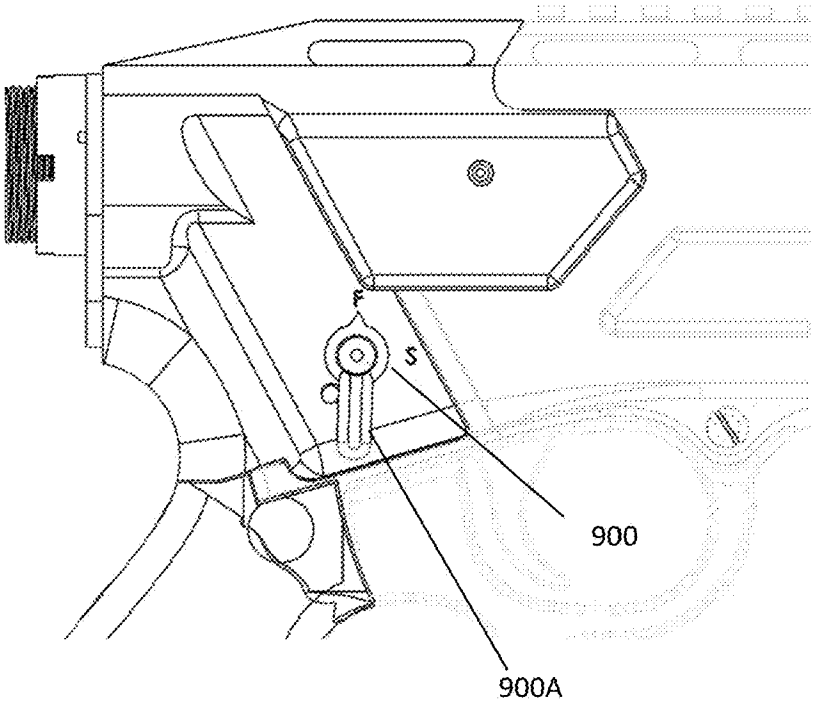

FIGS. 9A-9B are plan view diagrams of exemplary components of fire control mechanisms with a side-mounted safety selector 900 in a first safety configuration 900A, according to some embodiments. As shown in FIG. 9A, the safety selector 900 has an extended lever arm that is rotated downwards to place the firearm in the first safety configuration 900A (safety-off), with the lever arm of the safety selector 900 moved towards the bottom of the firearm.

Figure 9D:
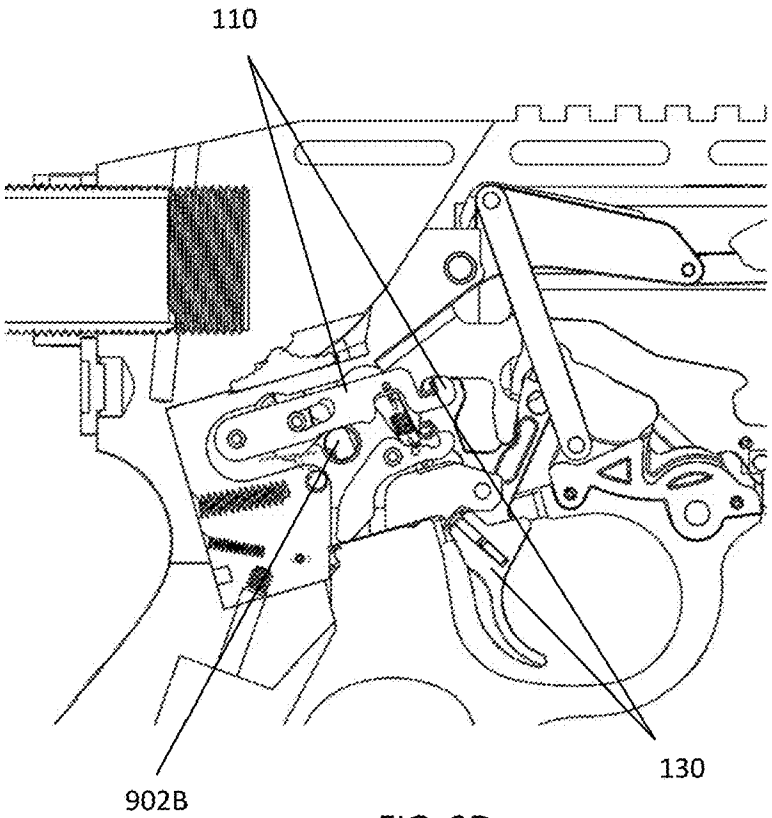
FIGS. 9C-9H are plan view diagrams of exemplary components of fire control mechanisms with a side-mounted safety selector in a second safety configuration, according to some embodiments.
Figure 9C:
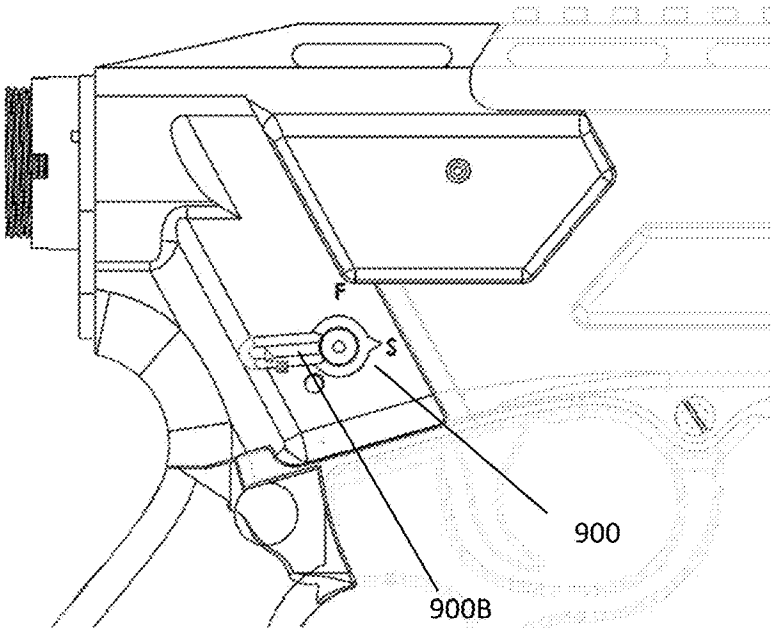

FIGS. 9C-9D are plan view diagrams of exemplary components of fire control mechanisms with the side-mounted safety selector 900 in a second safety configuration 900B, according to some embodiments. As shown in FIG. 9C, the extended lever arm of the safety selector 900 is rotated to the side to place the firearm in the second safety configuration 900B (safety-on), with the safety selector 900 moved towards the butt of the firearm.

FIGS. 9B and 9D shows safety bar 110 with a hooked end and trigger 130 (along with other components, which are not described in detail again in conjunction with FIGS. 9A-9D). In some embodiments, safety bar 110 may be configured to engage with a rotating shaft 902 of the safety selector 900 and with the trigger 130. Additionally, the safety bar 110 may be configured to transition, via rotation of the extended lever arm, between the first safety configuration in which safety is "off" (safety-off) and the second safety configuration in which safety is "on" (safety-on). In the exemplary embodiment of FIGS. 9A-9D, the safety bar 110 is moved from "fire" to "safe" by a non-cylindrical interfacing surface of the rotating shaft 902. In this example, the surface is D-shaped, but the techniques are not so limited and other configurations can be used in accordance with the techniques described herein (e.g., cam shaped and/or some other shape). When the flat portion of the surface of the rotating shaft 902 is in contact with the safety bar 110 as shown in FIG. 9B in position 902A, the safety bar is in its lowered "fire" position since the safety bar 110 is sitting in the "notch" or flat part of the D-shape of the rotating shaft 902 (with the hooked end of the safety bar 110 not preventing the trigger 130 from being actuated). When the rotating shaft 902 is rotated so that the rounded portion of the D-shaped surface is in contact with the bottom of the safety bar 110 as shown in FIG. 9D in position 902B, the rotating shaft 902 lifts the safety bar 110 into the "safe" position (with the hooked end of the safety bar 110 preventing the trigger 130 the trigger from being actuated).

Figure 9F:
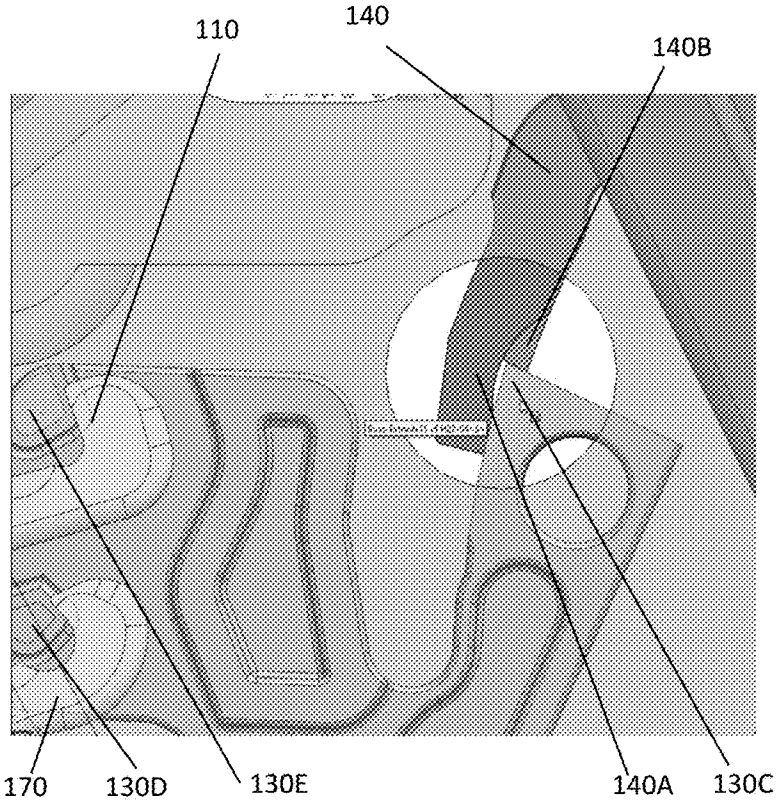
Figure 9E:
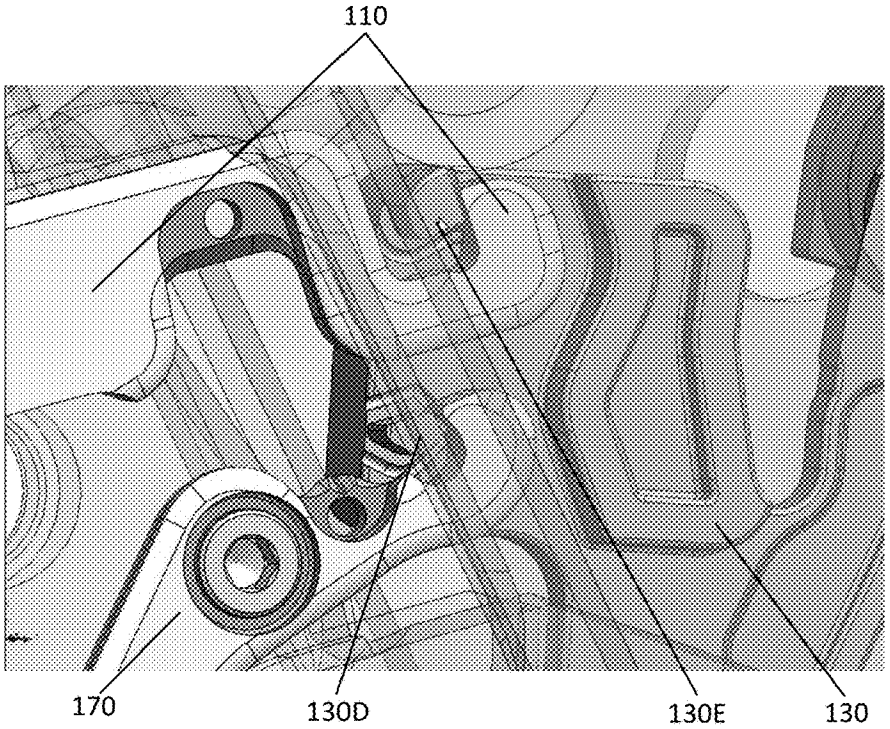

FIGS. 9E-H are plan view diagrams of exemplary components of fire control mechanisms with the side-mounted safety selector in the second safety configuration to illustrate how the fire control mechanisms can prevent actuation of the trigger 130, according to some embodiments. FIG. 9E shows that, prior to a user pressing the trigger 130, there can be a slight gap between the hooked end of the safety bar 110 and the boss 130E of the trigger 130. There can also be a slight gap between the boss 130D of the trigger 130 and the hooked end of the pivoter 170. FIG. 9F shows that, prior to the user pressing the trigger 130, there may not be a gap (or there may only be a slight gap) between the tab 140A of the sear 140 and the corner 130C of the trigger 130 (where, as explained above, the tab 140A can prevent the trigger 130 from being released too far when in the unfired position). The sear 140 is prevented from falling as described herein by the notch 140B of the sear 140 that rests on the corner 130C of the trigger 130.

Figure 9H:
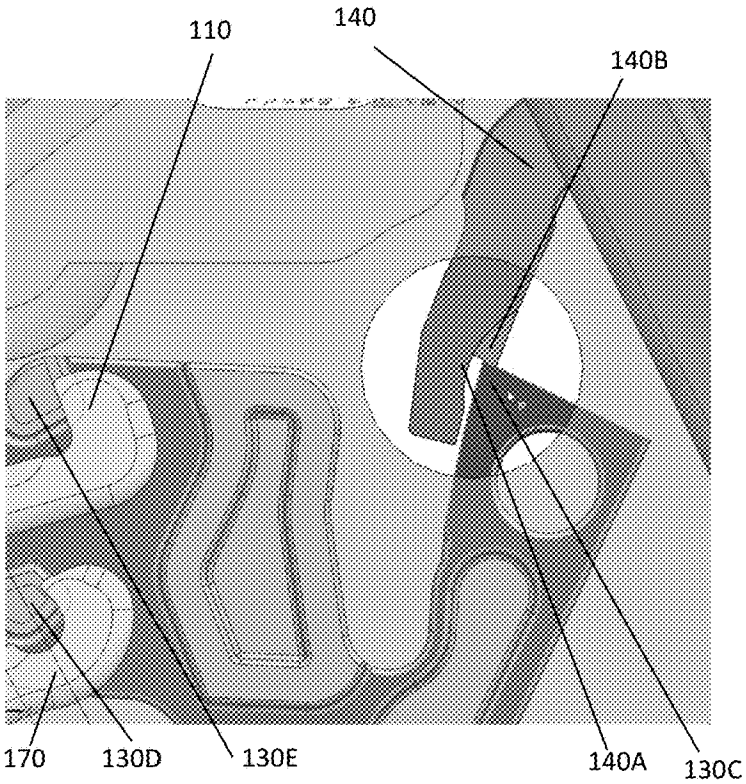
Figure 9G:
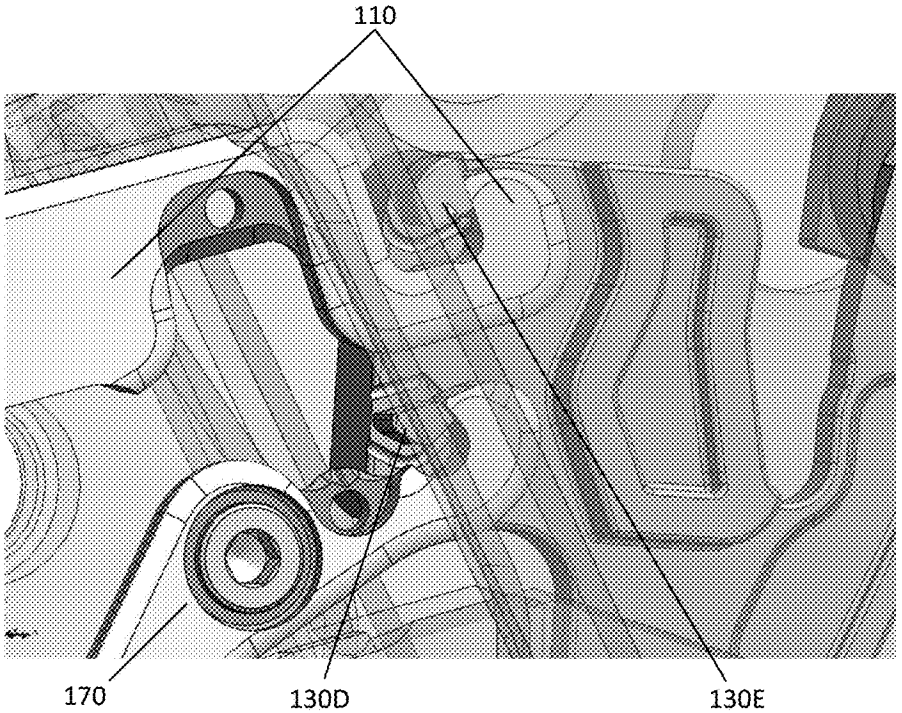

When the user presses the trigger 130, the trigger may slightly move but still be prevented from firing the firearm. For example, FIG. 9G shows that, when a user presses the trigger 130, the hooked end of the safety bar 110 can contact the boss 130E of the trigger 130 (and/or the hooked end of the pivoter 170 contacts the boss 130D of the trigger 130), preventing firing of the firearm. FIG. 9H shows that, when the user presses the trigger 130, a (slight) gap may occur between the tab 140A of the sear 140 and the corner 130C of the trigger 130. The sear 140 is still prevented from falling by the notch 140B of the sear 140 remaining in contact with the corner 130C of the trigger 130. Thus, the hooked end of the safety bar (and/or the hooked end of the pivoter 170) can serve to prevent or block the trigger from being pulled far enough to fire the firearm when in the safety-on position.

It should be appreciated that the exemplary configuration of FIGS. 9A-9H are not intended to be limiting. For example, the movement of the safety bar 110 could be reversed, such that the safety bar 110 could be raised away from the bottom of the firearm to place the firearm in an "off" (safety-off) configuration (with the hooked end of the safety bar 110 preventing actuation of the trigger 130), while the safety bar 110 could be lowered towards the bottom of the firearm to place the firearm in an "on" (safety-on) configuration (with the hooked end of the safety bar 110 not preventing actuation of the trigger 130). As another example, there may not be a gap between the notches 130D and/or 130E of the trigger 130 and the pivoter 170 and/or the safety bar 110, respectively.

It should be appreciated that while FIGS. 2-9H show exemplary configurations of firing control mechanisms, this is intended to be for illustrative purposes and not to be limiting. It should be appreciated that various other mechanical configurations and/or components can be used to achieve the techniques described herein.

It is to be understood that the disclosed subject matter is not limited in its application to the details of construction and to the arrangements of the components set forth in the following description or illustrated in the drawings. The disclosed subject matter is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods, and systems for carrying out the several purposes of the disclosed subject matter. It is important, therefore, that the description provided herein be regarded as including such equivalent constructions insofar as they do not depart from the spirit and scope of the disclosed subject matter.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

Also, the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

The word "exemplary" is used herein to mean serving as an example, instance, or illustration. Any embodiment, implementation, process, feature, etc. described herein as exemplary should therefore be understood to be an illustrative example and should not be understood to be a preferred or advantageous example unless otherwise indicated.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

Various aspects are described in this disclosure, which include, but are not limited to, the following aspects:

A1. A firearm comprising:

a safety bar configured to engage with a safety selector and with a trigger and to transition between a first safety configuration and a second safety configuration; and a sear configured to engage with the trigger and to transition between a first sear configuration and a second sear configuration, wherein:

in the first safety configuration, the safety bar is engaged with the safety selector such that the safety bar is engaged with the trigger to prevent the sear from being actuated, in the second safety configuration, the safety bar is engaged with the safety selector such that the safety bar is not engaged with the trigger, thereby allowing the trigger to be actuated to move the sear from the first sear configuration to the second sear configuration, in the first sear configuration, the sear or trigger is engaged with a hammer to prevent the hammer from being released to fire the firearm, and in the second sear configuration, the sear does not prevent the hammer from being released to fire the firearm.

A2. The firearm of A1, wherein in the second sear configuration, the sear is configured to be engaged by a first surface of a lever such that the sear is transitioned to the first sear configuration.

A3. The firearm of any of A1-A2, wherein a feature of a lever is configured to engage with a feature of the sear while the sear is in the second sear configuration to prevent the sear from remaining in between the second sear configuration and the first sear configuration.

B1. A firearm comprising:

a safety bar configured to engage with a safety selector and with a trigger and to transition between a first safety configuration and a second safety configuration, wherein:

in the first safety configuration, the safety bar is engaged with the safety selector such that the safety bar is engaged with the trigger to prevent the trigger from being actuated, in the second safety configuration, the safety bar is engaged with the safety selector such that the safety bar is not engaged with the trigger, thereby allowing the trigger to be actuated to move the sear surface of the trigger from the first trigger configuration to the second trigger configuration, in the first trigger configuration, the sear surface of the trigger is engaged with a hammer to prevent the hammer from being released to fire the firearm, and in the second trigger configuration, the sear surface of the trigger does not prevent the hammer from being released to fire the firearm.

B2. The firearm of B1, wherein the safety bar is configured to transition between the first safety configuration and the second safety configuration by pivoting around a first axis.

B3. The firearm of any of B1-B2, wherein the firearm is a lever action firearm.

C1. A firearm comprising:

a safety bar configured to engage with a safety selector and with a trigger or sear and to transition between a first safety configuration and a second safety configuration, wherein:

in the first safety configuration, the safety bar is engaged with the safety selector such that the safety bar is engaged with the trigger or sear to prevent the trigger from being actuated and/or to prevent the sear from releasing the hammer to fire the firearm, and in the second safety configuration, the safety bar is engaged with the safety selector such that the safety bar is not engaged with the trigger or sear, allowing the trigger to be actuated and/or allowing the sear to release the hammer to fire the firearm, and the safety bar includes a region configured to receive a portion of the safety selector, and the safety bar is configured to engage with the safety selector via the region and the portion.

C2. The firearm of C1, wherein the region is:

symmetric across a first plane orthogonal to a primary direction of travel of the portion through the region and asymmetric across a second plane orthogonal to the first plane and to the primary direction of travel.

C3. The firearm of C2, wherein the region includes:

a first end of the primary direction of travel and a second end of the primary direction of travel, and a first notch at a top portion of the first end and a second notch at a top portion of the second end.

D1. A firearm comprising:

a pivoter configured to engage with a trigger or sear and to transition between a first pivoter configuration and a second pivoter configuration; and a lever, wherein:

in the first pivoter configuration:

the pivoter is engaged with the trigger or sear when the lever is open to prevent the sear from releasing the hammer to fire the firearm, and in the second pivoter configuration:

the pivoter is not engaged with the trigger or sear when the lever is closed, allowing the sear to release the hammer to fire the firearm upon actuation of the trigger.

D2. The firearm of D1, wherein the pivoter is engaged with the trigger or sear when the lever is open to prevent the sear from being actuated.

D3. The firearm of any of D1-D2, wherein the safety bar is engaged with the pivoter via a spring.

E1. A firearm comprising:

a trigger; and a sear configured to engage with the trigger and to transition between a first sear configuration and a second sear configuration, wherein:

in the first sear configuration, the sear is engaged with a hammer to prevent the hammer from being released to fire the firearm, in the second sear configuration, the sear does not prevent the hammer from being released to fire the firearm, the sear is biased towards the second sear configuration and when the trigger is in an unactuated position, the sear is prevented from moving to the second sear configuration by the trigger, and when the trigger is actuated, the sear moves to the second sear configuration.

E2. The firearm of E1, wherein the sear is configured to be engaged by the hammer via an additional protrusion of the sear and a second surface of the hammer such that the sear is transitioned to the second sear configuration by the second surface of the hammer.

E3. The firearm of any of E1-E2, wherein the sear is configured to be engaged by the hammer via an additional protrusion of the sear and a first protrusion of the hammer such that the sear is prevented from transitioning to the first sear configuration until the hammer is transitioned towards an unreleased position.

E4. The firearm of any of E1-E3, wherein in the second sear configuration, a first surface of the sear is between at least two surfaces of the trigger.

E5. The firearm of any of E1-E4, wherein in the first sear configuration, the sear is configured to engage with the hammer via a non-hook-shaped protrusion of the sear and a first surface of the hammer.

E6. The firearm of any of E1-E5, wherein the trigger is configured to host a screw configured to adjust creep or pull force of the trigger within a limit imposed by a dumbbell-shaped component.

E7. The firearm of any of E1-E6, wherein the trigger is configured to host a screw configured to adjust creep or pull force of the trigger within a limit imposed by a cylinder-shaped component.

The invention claimed is:

1. A firearm comprising:

a safety bar configured to engage with a safety selector and with a trigger and to transition between a first safety configuration and a second safety configuration, wherein:

in the first safety configuration, the safety bar is engaged with the safety selector such that the safety bar is engaged with the trigger to prevent the trigger from being actuated, in the second safety configuration, the safety bar is engaged with the safety selector such that the safety bar is not engaged with the trigger, allowing the trigger to be actuated, and the safety bar includes a region configured to receive a portion of the safety selector, and the safety bar is configured to engage with the safety selector via the region and the portion.

2. The firearm of claim 1, wherein the region is:

symmetric across a first plane orthogonal to a primary direction of travel of the portion through the region, and asymmetric across a second plane orthogonal to the first plane and parallel to the primary direction of travel.

3. The firearm of claim 2, wherein the region includes:

a first end of the primary direction of travel and a second end of the primary direction of travel, and a first notch at a top portion of the first end and a second notch at a top portion of the second end.

4. The firearm of claim 1, further comprising a sear configured to engage with the trigger and to transition between a first sear configuration and a second sear configuration, wherein:

in the first safety configuration, the safety bar is engaged with the safety selector such that the safety bar is engaged with the trigger to prevent the sear from being actuated, in the second safety configuration, the safety bar is engaged with the safety selector such that the safety bar is not engaged with the trigger, thereby allowing the trigger to be actuated to move the sear from the first sear configuration to the second sear configuration, in the first sear configuration, the sear is engaged with a hammer to prevent the hammer from being released to fire the firearm, and in the second sear configuration, the sear does not prevent the hammer from being released to fire the firearm.

5. The firearm of claim 4, wherein in the second sear configuration, the sear is configured to be engaged by a first surface of a lever such that the sear is transitioned to the first sear configuration.

6. The firearm of claim 4, wherein a feature of a lever is configured to engage with a feature of the sear while the sear is in the second sear configuration to prevent the sear from remaining in between the second sear configuration and the first sear configuration.

7. The firearm of claim 1, wherein the region is a cutout.

8. The firearm of claim 7, wherein the cutout comprises at least one detent feature.

9. The firearm of claim 8, wherein the at least one detent feature is disposed in a side of the cutout distal to the trigger of the firearm.

10. The firearm of claim 8, wherein the portion is a pin.

11. The firearm of claim 10, wherein the pin is configured to engage with the at least one detent feature to retain the pin in the at least one detent feature.

12. The firearm of claim 1, wherein the safety bar comprises a hooked end.

13. The firearm of claim 12, wherein the trigger comprises a boss.

14. The firearm of claim 13, wherein the hooked end of the safety bar is configured to:

engage with the boss of the trigger when the firearm is in the first safety configuration; and not engage with the boss of the trigger when the firearm is in the second safety configuration.

15. The firearm of claim 14, further comprising a gap between the boss and the hooked end when the firearm is in the first safety configuration such that the boss fills the gap, contacting the hooked end, when a user attempts to actuate the trigger.

16. The firearm of claim 12, wherein the safety bar is configured to pivot about an axis.

17. The firearm of claim 16, wherein the axis is disposed on an end of the safety bar opposite the hooked end.

18. The firearm of claim 17, wherein the region is disposed between the axis and the hooked end.

19. The firearm of claim 16, wherein the safety bar is configured to:

pivot about the axis such that the hooked end travels away from a pivot axis of the trigger when the safety selector transitions from the second safety configuration to the first safety configuration; and pivot about the axis such that the hooked end travels towards a pivot axis of the trigger when the safety selector transitions from the first safety configuration to the second safety configuration.

20. The firearm of claim 1, wherein the firearm is a lever action firearm.

* * * * *